US011220407B2

(12) United States Patent
Morikawa

(10) Patent No.: US 11,220,407 B2
(45) Date of Patent: Jan. 11, 2022

(54) MEDIUM CONVEYANCE DEVICE

(71) Applicant: PFU Limited, Ishikawa (JP)

(72) Inventor: Shuichi Morikawa, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 231 days.

(21) Appl. No.: 16/569,412

(22) Filed: Sep. 12, 2019

(65) Prior Publication Data

US 2020/0002110 A1 Jan. 2, 2020

Related U.S. Application Data

(63) Continuation of application No. PCT/JP2017/010776, filed on Mar. 16, 2017.

(51) Int. Cl.
*B65H 3/06* (2006.01)
*B65H 3/52* (2006.01)

(52) U.S. Cl.
CPC ..... *B65H 3/0684* (2013.01); *B65H 3/0638* (2013.01); *B65H 3/5284* (2013.01); *B65H 2404/1341* (2013.01); *B65H 2404/152* (2013.01)

(58) Field of Classification Search
CPC ..... B65H 3/0684; B65H 3/5223; B65H 2404/1341; B65H 2404/144; B65H 2404/152; B65H 2511/13
See application file for complete search history.

(56) References Cited

U.S. PATENT DOCUMENTS 8,523,173 B2 * 9/2013 Hayayumi ..... B65H 1/266 271/117
8,991,814 B2 * 3/2015 Hirahara ..... B65H 1/266 271/117
9,896,287 B2 * 2/2018 Dahlqvist ..... B65H 1/14
2002/0038932 A1 * 4/2002 Kaiga ..... B65H 3/5223 271/114
2009/0014940 A1 * 1/2009 Lim ..... B65H 3/0607 271/3.14
2015/0084263 A1 * 3/2015 Kanzawa ..... B65H 3/0676 271/3.2
2015/0203307 A1 * 7/2015 Tanaka ..... B65H 7/06 271/117

FOREIGN PATENT DOCUMENTS

JP S53-162625 U 12/1978
JP H07-040648 U 7/1995
JP H8-259021 A 10/1996
JP H11-263464 A 9/1999
JP 2000-327157 A 11/2000
(Continued)

OTHER PUBLICATIONS

International Search Report issued in corresponding International Patent Application No. PCT/JP2017/010776, dated Jun. 6, 2017, with English translation.

*Primary Examiner* — Prasad V Gokhale
(74) *Attorney, Agent, or Firm* — McDermott Will & Emery LLP

(57) ABSTRACT

A medium conveyance device includes a guiding member that is movably supported on a frame, a pick roller that is rotatably supported on the guiding member and that rotates to feed a medium that is placed on a tray to a feed roller, and a joint unit that transmits a rotation force from a drive shaft to the pick roller.

4 Claims, 16 Drawing Sheets

(56) References Cited

FOREIGN PATENT DOCUMENTS

| | | | |
|---|---|---|---|
| JP | 2005-015184 | A | 1/2005 |
| JP | 2005-239336 | A | 9/2005 |
| JP | 2006-232485 | A | 9/2006 |
| JP | 2008-007261 | A | 1/2008 |
| JP | 2012-188279 | A | 10/2012 |
| JP | 2013-006658 | A | 1/2013 |
| JP | 2013-035673 | A | 2/2013 |
| JP | 2014-114083 | A | 6/2014 |

* cited by examiner

MEDIUM CONVEYANCE DEVICE

CROSS-REFERENCE TO RELATED APPLICATION

This application is a continuation of International Application No. PCT/JP2017/010776, filed on Mar. 16, 2017, the entire contents of which are incorporated herein by reference.

FIELD

The disclosed technology relates to a medium conveyance device.

BACKGROUND

Image read devices in which a return path on which an original is conveyed while being curved is formed are known. In such an image read device, a stacker on which ejected originals are placed can be arranged near a tray on which originals to be fed are placed and thus it is possible to reduce a setting space. In such an image read device, a straight path on which an original is conveyed without being curved is further formed and conveyance paths are switched such that a thin original is conveyed on the return path and a thick original is conveyed on the straight path (refer to Japanese Laid-open Patent Publication No. H11-263464, Japanese Laid-open Patent Publication No. 2012-188279, and Japanese Laid-open Patent Publication No. 2006-232485).

Such image read devices however have a problem in that an error occurs when thin originals and thick originals are fed from the stacker.

SUMMARY

According to an aspect of an embodiment, a medium conveyance device includes a guiding member that is movably supported on a frame, a pick roller that is rotatably supported on the guiding member and that rotates to feed a medium that is placed on a tray to a feed roller, and a joint unit that transmits a rotation force from a drive shaft to the pick roller.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Preferred embodiments of the disclosure will be explained with reference to accompanying drawings. With reference to the accompanying drawings, medium conveyance devices according to embodiments disclosed herein will be described below. The following description does not limit the disclosure. In the following description, the same components are denoted with the same reference numbers and redundant description thereof will be omitted.

First Embodiment

Figure 1:
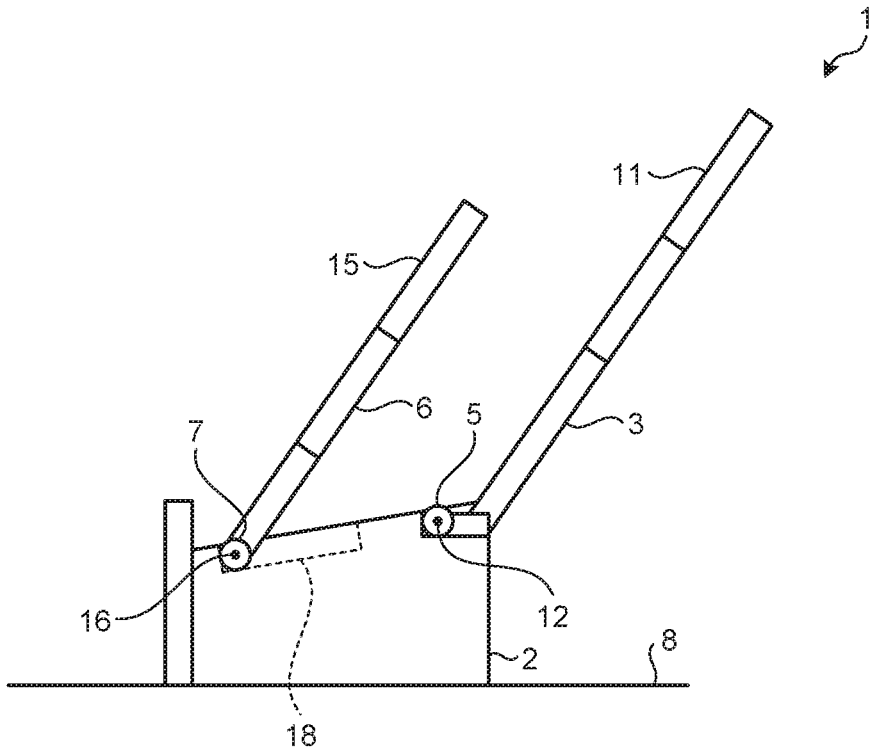
FIG. 1 is a side view of a medium conveyance device of a first embodiment.

FIG. 1 is a side view of a medium conveyance device 1 of a first embodiment. The medium conveyance device 1 is used as an image read device and, as illustrated in FIG. 1, includes a casing 2, a tray 3, a tray supporter 5, a stacker 6, and a stacker supporter 7. The casing 2 is formed into a box shape and forms an outer shell of the body of the medium conveyance device 1. The casing 2 is placed on a setting surface on which the medium conveyance device 1 is set. The tray 3 is formed into a platy shape, and a tray placement surface 11 that is approximately flat is formed in the tray 3. The tray 3 is arranged behind and above the casing 2 (on the right side in FIG. 1) such that, when a setting surface 8 is horizontal, the tray placement surface 11 is oriented obliquely upward and the angle formed by the tray placement surface 11 with respect to the setting surface 8 is equal to 55 degrees. The tray supporter 5 supports the tray 3 such that the tray 3 is able to turn about a rotation axis 12 with respect to the casing 2. The rotation axis 12 is parallel with the setting surface 8 and is parallel with the tray placement surface 11. The tray supporter 5 further inhibits the tray 3 from turning such that the angle formed by the tray placement surface 11 and the setting surface 8 is not smaller than 55 degrees. In other words, the tray supporter 5 supports the tray 3 such that the tray 3 does not turn clockwise about the rotation axis 12 from the state illustrated in FIG. 1 because of the force of gravity.

The stacker 6 is formed into a platy shape, and a stacker placement surface 15 that is approximately flat is formed in the stacker 6. The stacker 6 is arranged on an upper part of the casing 2 on the front side (the left side in FIG. 1) such that the stacker placement surface 15 is approximately parallel with the tray placement surface 11. In other words, the stacker 6 is arranged such that the stacker placement surface 15 is oriented obliquely upward and the angle formed by the stacker placement surface 15 with respect to the setting surface 8 is equal to 55 degrees. The stacker 6 is arranged as described above and thus covers part of the tray placement surface 11. The stacker supporter 7 supports the stacker 6 such that the stacker 6 is able to turn about a rotation axis 16 with respect to the casing 2. The rotation axis 16 is parallel with the rotation axis 12, in other words, is parallel with the setting surface 8 and is parallel with the stacker placement surface 15. The stacker supporter 7 further inhibits the stacker 6 from turning such that the angle formed by the stacker placement surface 15 with respect to the setting surface 8 is not larger than 55 degrees. In other words, the stacker supporter 7 supports the stacker 6 such that the stacker 6 does not turn counterclockwise about the rotation axis 16 from the state illustrated in FIG. 1.

In the medium conveyance device 1, a stacker storage area 18 is formed. The stacker storage area 18 is formed between the tray 3 and the stacker 6 in the upper part of the casing 2. In other words, the stacker storage area 18 is arranged on the back side of the upper part of the casing 2 with respect to the rotation axis 16 of the stacker 6 and is arranged on the front side of the upper part of the casing 2 with respect to the rotation axis 12 of the tray 3.

Figure 2:
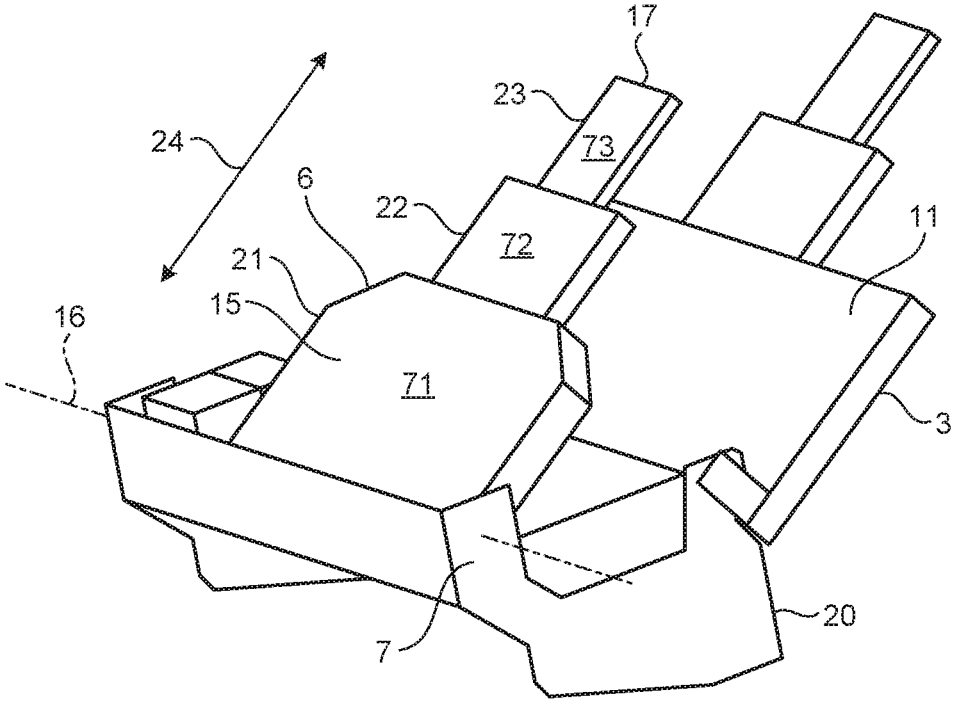
FIG. 2 is a perspective view of a tray and a stacker.

FIG. 2 is a perspective view of the tray 3 and the stacker 6. As illustrated in FIG. 2, the medium conveyance device 1 further includes a frame 20. The frame 20 is fixed to the body of the medium conveyance device 1 and, specifically, is arranged in the casing 2 and is fixed to the casing 2. The frame 20 is fixed onto the setting surface 8 when the casing 2 is placed on the setting surface 8. The stacker 6 includes a first stacker member 21, a second stacker member 22, and a third stacker member 23. The first stacker member 21 is formed into a platy shape and a first stacker placement surface 71 is formed in the first stacker member 21. The first stacker member 21 is supported by the stacker supporter 7 and on the frame 20 such that the first stacker member 21 is able to turn about the rotation axis 16.

The second stacker member 22 is formed into a platy shape that is thinner than the first stacker member 21 and a second stacker placement surface 72 is formed in the second stacker member 22. The second stacker member 22 is supported on the first stacker member 21 movably in parallel with an extension-contraction direction 24 such that the second stacker member 22 is arranged in an extension position or a contraction position. The extension-contraction direction 24 is orthogonal to the rotation axis 16 and is parallel with the stacker placement surface 15. The second stacker member 22 is pulled out of the first stacker member 21 and accordingly is arranged in the extension position and the second stacker member 22 is pushed into the first stacker member 21 and accordingly is arranged in the contraction position. The second stacker member 22 is arranged in the contraction position and accordingly the second stacker placement surface 72 overlaps the first stacker placement surface 71, and the second stacker member 22 is arranged in the extension position and accordingly the second stacker placement surface 72 is aligned with the first stacker placement surface 71.

The third stacker member 23 is formed into a platy shape thinner than the second stacker member 22, and a third stacker placement surface 73 is formed in the third stacker member 23. The third stacker member 23 is supported on the second stacker member 22 movably in parallel with the extension-contraction direction 24 such that the third stacker member 23 is arranged in an extension position or a contraction position. The third stacker member 23 is pulled out of the second stacker member 22 and accordingly is arranged in the extension position, and the third stacker member 23 is pushed into the second stacker member 22 and accordingly is arranged in the contraction position. The third stacker member 23 is arranged in the contraction position and accordingly the third stacker placement surface 73 overlaps the second stacker placement surface 72, and the third stacker member 23 is arranged in the extension position and accordingly the third stacker placement surface 73 is aligned with the second stacker placement surface 72. The stacker 6 is formed in this manner and thus is formed to be contractible such that a stacker end 17 on the distal side with respect to the rotation axis 16 moves close to the rotation axis 16 and to be extensible such that the stacker end 17 moves away from the rotation axis 16. The second stacker member 22 is arranged in the extension position and the third stacker member 23 is arranged in the extension position and accordingly the first stacker placement surface 71, the second stacker placement surface 72, and the third stacker placement surface 73 are formed on the stacker placement surface 15.

The stacker 6 further includes an interlock mechanism (not illustrated in FIG. 2). The interlock mechanism mechanically converts motion of the second stacker member 22 to be pulled out of the first stacker member 21 into motion of the third stacker member 23 to be pulled out of the second stacker member 22. The interlock mechanism further mechanically converts motion of the second stacker member 22 to be pushed into the first stacker member 21 into motion of the third stacker member 23 to be pushed into the second stacker member 22. The interlock mechanism enables the second stacker member 22 to be pulled out of the first stacker member 21 and pushed into the first stacker member 21 and accordingly the stacker 6 extends and contracts.

Figure 3:
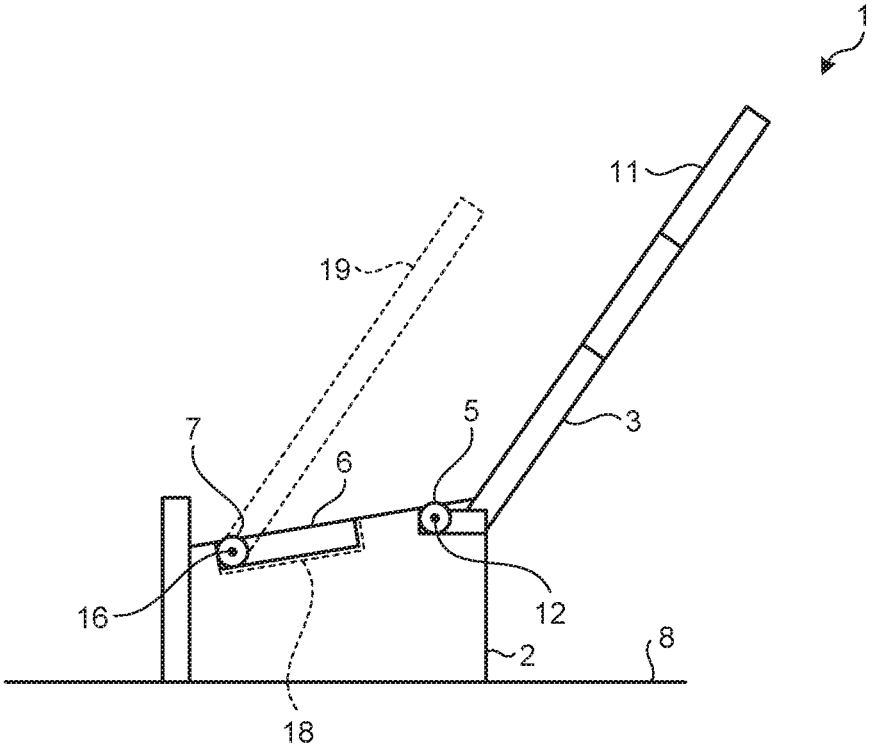
FIG. 3 is a side view of the medium conveyance device in the case where the stacker is stored.

FIG. 3 is a side view of the medium conveyance device 1 in the case where the stacker 6 is housed in the stacker storage area 18. As illustrated in FIG. 3, when caused to contract, the stacker 6 turns about the rotation axis 16 and accordingly is arranged and stored in the stacker storage area 18. In other words, the stacker supporter 7 supports the stacker 6 movably such that the stacker 6 is arranged in the stacker storage area 18 or a stacker development area 19. The stacker development area 19 is an area where the stacker 6 is arranged in FIG. 1. In other words, the stacker 6 is arranged in the stacker development area 19 and accordingly the stacker placement surface 15 is oriented obliquely upward and the angle formed by the stacker placement surface 15 with respect to the setting surface 8 is approximately equal to 55 degrees.

The stacker 6 is arranged in the stacker storage area 18 and accordingly the tray placement surface 11 is exposed and, compared to the case where the stacker 6 is arranged in the stacker development area 19, it is possible to reduce the area covered with the stacker 6 in the tray placement surface 11. In other words, the area of a diagram obtained by orthogonally projecting the stacker 6 that is arranged in the stacker storage area 18 onto the tray placement surface 11 is smaller than the area of a diagram obtained by orthogonally projecting the stacker 6 that is arranged in the stacker development area 19 onto the tray placement surface 11.

Figure 4:
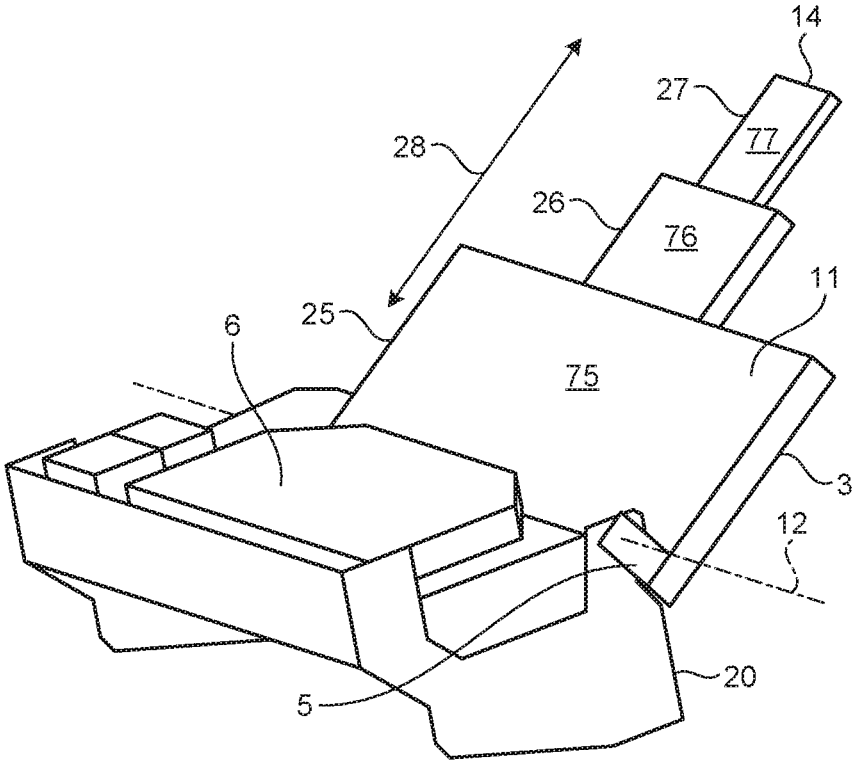
FIG. 4 is a perspective view of the stacker and the tray in the case where the stacker is stored.

FIG. 4 is a perspective view of the stacker 6 and the tray 3 in the case where the stacker 6 is stored in the stacker storage area 18. As illustrated in FIG. 4, the tray 3 includes a first tray member 25, a second tray member 26, and a third tray member 27. The first tray member 25 is formed into a platy shape, and a first tray placement surface 75 is formed in the first tray member 25. The first tray member 25 is supported by the tray supporter 5 and on the frame 20 such that the first tray member 25 is able to turn about the rotation axis 12 to be arranged in a tray development position or a tray storage position. The first tray member 25 is arranged in the tray development position when the tray placement surface 11 is oriented obliquely upward.

The second tray member 26 is formed into a platy shape thinner than the first tray member 25, and a second tray placement surface 76 is formed in the second tray member 26. The second tray member 26 is supported on the first tray member 25 movably in parallel with an extension-contraction direction 28 to be arranged in an extension position or a contraction position. The extension-contraction direction 28 is orthogonal to the rotation axis 12 and is parallel with the tray placement surface 11. The second tray member 26 is pulled out of the first tray member 25 and accordingly is arranged in the extension position. The second tray member 26 is pushed into the first tray member 25 and accordingly is arranged in the contraction position. The second tray placement surface 76 is arranged in the contraction position and accordingly overlaps the first tray placement surface 75, and the second tray placement surface 76 is arranged in the extension position and accordingly is aligned with the first tray placement surface 75.

The third tray member 27 is formed into a platy shape thinner than the second tray member 26, and a third tray placement surface 77 is formed in the third tray member 27. The third tray member 27 is supported on the second tray member 26 movably in parallel with the extension-contraction direction 28 such that the third tray member 27 is arranged in an extension position or a contraction position. The third tray member 27 is pulled out of the second tray member 26 and accordingly is arranged in the extension position. The third tray member 27 is pushed into the second tray member 26 and accordingly is arranged in the contraction position. The third tray placement surface 77 is arranged in the contraction position and accordingly overlaps the second tray placement surface 76, and the third tray placement surface 77 is arranged in the extension position and accordingly is aligned with the second tray placement surface 76. The tray 3 is formed as described above and thus is formed to be contractible such that a tray end 14 on the distal side with respect to the rotation axis 12 moves close to the rotation axis 12 and to be extensible such that the tray end 14 moves away from the rotation axis 12. The second tray member 26 is arranged in the extension position and the third tray member 27 is arranged in the extension position and accordingly the first tray placement surface 75, the second tray placement surface 76, and the third tray placement surface 77 are formed on the tray placement surface 11.

Figure 5:
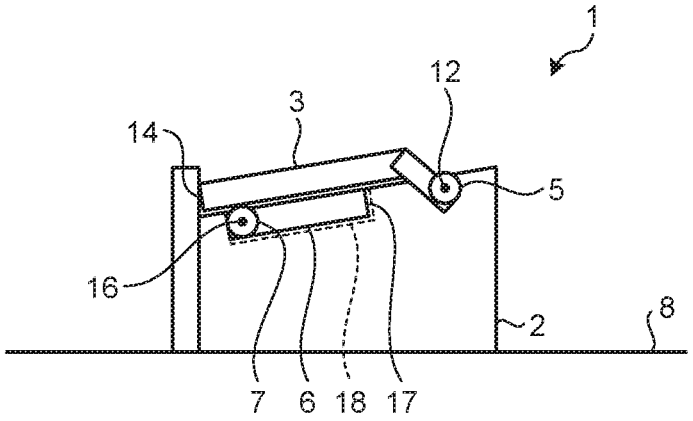
FIG. 5 is a side view of the medium conveyance device in the case where the tray is stored.
Figure 6:
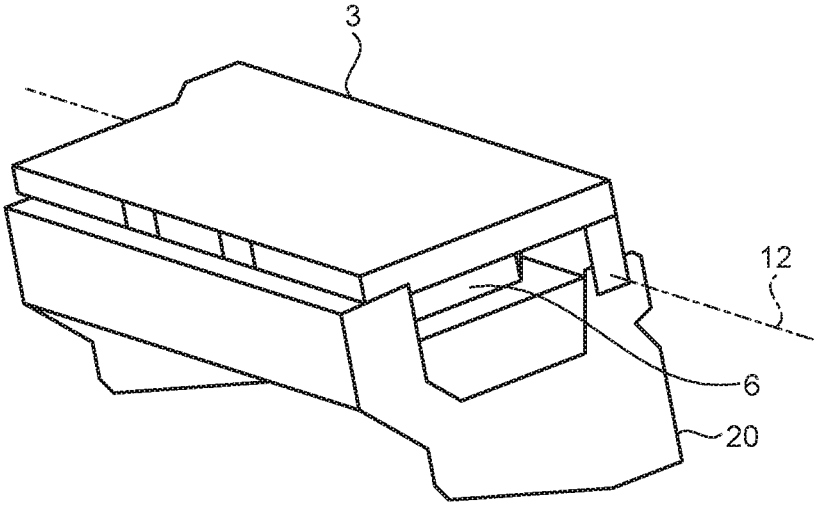
FIG. 6 is a perspective view of the stacker and the tray in the case where the tray is stored.

FIG. 5 is a side view of the medium conveyance device 1 in the case where the tray 3 is stored. FIG. 6 is a perspective view of the stacker 6 and the tray 3 in the case where the tray 3 is stored. As illustrated in FIG. 5, when the tray 3 contracts in the case where the stacker 6 is stored in the stacker storage area 18, the tray 3 is storable above the stacker 6. In other words, when the tray 3 is stored, the first tray member 25 is arranged in the tray storage position and the first tray placement surface 75 is opposed to the stacker 6. When the first tray member 25 is arranged in the tray storage position, the second tray member 26 is arranged in the contraction position and is pushed into the first tray member 25. When the second tray member 26 is arranged in the contraction position, the third tray member 27 is arranged in the contraction position and is pushed into the second tray member 26. Storing the tray 3 reduces the height of the medium conveyance device 1, thereby reducing the size. Storing the tray 3 further enables the tray 3 to cover the stacker 6 as illustrated in FIG. 6.

The tray 3 further includes an interlock mechanism (not illustrated in the drawings). The interlock mechanism mechanically converts motion of the first tray member 25 to turn to the tray storage position into motion of the second tray member 26 to move to the contraction position. The interlock mechanism further mechanically converts motion of the second tray member 26 to move to the contraction position into motion of the third tray member 27 to move to the contraction position. The interlock mechanism further mechanically converts motion of the first tray member 25 to turn to the tray development position into motion of the second tray member 26 to move to the extension position. The interlock mechanism further converts motion of the second tray member 26 to move to the extension position into motion of the third tray member 27 to move to the extension position.

Figure 7:
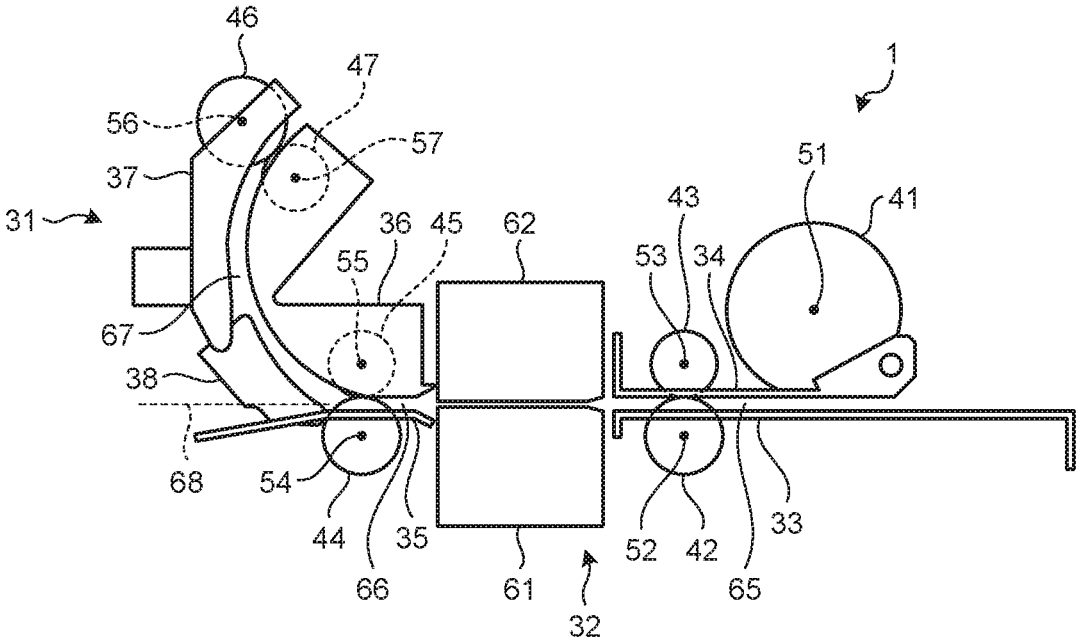
FIG. 7 is a side cross-sectional view of the conveyance device and a read device.

FIG. 7 is a side cross-sectional view of a conveyance device 31 and a read device 32. As illustrated in FIG. 7, the medium conveyance device 1 further includes the conveyance device 31 and the read device 32.

Conveyance Device

The conveyance device 31 is arranged in the casing 2. The conveyance device 31 includes a plurality of conveyance guides 33 to 37, a switch guide 38, and a plurality of conveyance rollers 41 to 47. The conveyance guides 33 to 37 include a first conveyance guide 33, a second conveyance guide 34, a third conveyance guide 35, a fourth conveyance guide 36, and a fifth conveyance guide 37. The first conveyance guide 33 is formed into a platy shape that is approximately flat. The first conveyance guide 33 is arranged along a plane that is approximately parallel with the setting surface 8 and the first conveyance guide 33 is fixed to the frame 20. The second conveyance guide 34 is formed into a platy shape that is approximately flat. The second conveyance guide 34 is arranged above the first conveyance guide 33 such that the second conveyance guide 34 is opposed to the first conveyance guide 33. The second conveyance guide 34 is further supported on the frame 20 such that the second conveyance guide 34 is ascendable and descendible in the vertical direction that is orthogonal to a plane along which the first conveyance guide 33 is.

The third conveyance guide 35 is formed into an approximately platy shape. The third conveyance guide 35 is arranged in front of the first conveyance guide 33 such that the third conveyance guide 35 is along the plane along which the first conveyance guide 33 is, and the third conveyance guide 35 is fixed to the frame 20. The fourth conveyance guide 36 is formed into a pillar shape and a convex surface along part of a side surface of the cylinder is formed in the fourth conveyance guide 36. The fourth conveyance guide 36 is arranged above the third conveyance guide 35 such that part of the convex surface is opposed to the third conveyance guide 35. The fourth conveyance guide 36 is fixed to the frame 20. The fifth conveyance guide 37 is formed into a pillar shape and a concave surface along part of the side surface of the cylinder is formed in the fifth conveyance guide 37. The fifth conveyance guide 37 is arranged in front of the fourth conveyance guide 36 such that the concave surface of the fifth conveyance guide 37 is opposed to part of the convex surface of the fourth conveyance guide 36.

The conveyance device 31 includes the conveyance guides 33 to 37 and thus a conveyance path 65, a conveyance path 66, a return conveyance path 67, and a straight conveyance path 68 are formed. The conveyance path 65 is formed between the first conveyance guide 33 and the second conveyance guide 34. The conveyance path 65 is formed along a plane that is parallel with the setting surface 8. The conveyance path 65 is formed further such that, when the tray 3 is developed, the conveyance path 65 is connected to the tray placement surface 11. The conveyance path 66 is formed between the third conveyance guide 35 and the fourth conveyance guide 36. The conveyance path 66 is formed along the plane along the conveyance path 65.

The return conveyance path 67 is formed between the fourth conveyance guide 36 and the fifth conveyance guide 37. The return conveyance path 67 is formed along the side surface of the cylinder. The return conveyance path 67 is formed further such that, when the stacker 6 is arranged in the stacker development area 19, the return conveyance path 67 is connected to the stacker placement surface 15. The straight conveyance path 68 is formed under the fifth conveyance guide 37. The straight conveyance path 68 is formed along the plane along the conveyance path 65. The straight conveyance path 68 is formed further to be connected to the outside of the casing 2.

The switch guide 38 is formed into an approximately platy shape and is supported on the frame 20 movably such that the switch guide 38 is arranged in a return path guide position or a straight path guide position. The switch guide 38 is arranged in the return path guide position and accordingly disconnects the conveyance path 66 and the straight conveyance path 68 and connects the conveyance path 66 to the return conveyance path 67. The switch guide 38 is arranged in the straight path guide position and accordingly disconnects the conveyance path 66 and the return conveyance path 67 and connects the conveyance path 66 to the straight conveyance path 68.

The conveyance rollers 41 to 47 include a pick roller 41, a first drive roller 42, a first pinch roller 43, a second drive roller 44, a second pinch roller 45, a third drive roller 46, and a third pinch roller 47. The pick roller 41 is formed into a cylindrical shape and is arranged between the tray 3 and the conveyance path 65. The pick roller 41 is supported on the frame 20 rotatably about a rotation axis 51. The rotation axis 51 is parallel with the rotation axis 12. Furthermore, the pick roller 41 is arranged such that, when the tray 3 is developed, the pick roller 41 contacts the top one of originals that are placed on the tray 3. The pick roller 41 rotates normally (clockwise in FIG. 7) about the rotation axis 51 and accordingly the top one of the originals is conveyed to the conveyance path 65.

The first drive roller 42 is formed into a cylindrical shape and is arranged under the conveyance path 65 and in front of the pick roller 41. The first drive roller 42 is supported on the frame 20 rotatably about a rotation axis 52. The rotation axis 52 is parallel with the rotation axis 12. The first pinch roller 43 is formed into a cylindrical shape and is arranged above the first drive roller 42. The first pinch roller 43 is supported on the frame 20 such that the first pinch roller 43 is rotatable about a rotation axis 53 and is ascendable and descendible vertically. The rotation axis 53 is parallel with the rotation axis 52. The first drive roller 42 and the first pinch roller 43 are arranged further such that the original conveyed on the conveyance path 65 is interposed between the first drive roller 42 and the first pinch roller 43. The first drive roller 42 rotates normally (counterclockwise in FIG. 7) about the rotation axis 52 and the original that is conveyed on the conveyance path 65 is pushed by the first pinch roller 43 against the first drive roller 42 and accordingly is conveyed to the conveyance path 66. The original conveyed on the conveyance path 65 contacts the second conveyance guide 34 and accordingly the second conveyance guide 34 ascends and descends with respect to the frame 20 to be arranged at a level corresponding to the thickness of the original. In other words, the thicker the original conveyed on the conveyance path 65 is, the higher the level at which the second conveyance guide 34 is arranged is. The first pinch roller 43 ascends and descends to be arranged at a level corresponding to the thickness of the original conveyed on the conveyance path 65. In other words, the thicker the original conveyed on the conveyance path 65 is, the higher the level at which the first pinch roller 43 is arranged is.

The second drive roller 44 is formed into a cylindrical shape and is arranged under the conveyance path 66. The second drive roller 44 is supported on the frame 20 rotatably about a rotation axis 54. The rotation axis 54 is parallel with the rotation axis 52. The second pinch roller 45 is formed into a cylindrical shape and is arranged above the conveyance path 66. The second pinch roller 45 is supported on the frame 20 such that the second pinch roller 45 is rotatable about a rotation axis 55 and is ascendable and descendible vertically. The rotation axis 55 is parallel with the rotation axis 54. The second drive roller 44 and the second pinch roller 45 are arranged further such that the original conveyed on the conveyance path 66 is interposed between the second drive roller 44 and the second pinch roller 45. The second drive roller 44 rotates normally (counterclockwise in FIG. 7) about the rotation axis 54 and the original conveyed on the conveyance path 66 is pushed by the second pinch roller 45 against the second drive roller 44 and accordingly is conveyed to the return conveyance path 67 or the straight conveyance path 68. The second pinch roller 45 ascends and descends to be arranged at the level corresponding to the thickness of the original conveyed on the conveyance path 66. In other words, the thicker the original conveyed on the conveyance path 66 is, the higher the level at which the second pinch roller 45 is arranged is.

The third drive roller 46 is formed into a cylindrical shape and is arranged in front of the return conveyance path 67. The third drive roller 46 is supported on the frame 20 rotatably about a rotation axis 56. The rotation axis 56 is parallel with the rotation axis 52. The third pinch roller 47 is formed into a cylindrical shape and is arranged behind the third drive roller 46. The third pinch roller 47 is supported on the frame 20 rotatably about a rotation axis 57. The rotation axis 57 is parallel with the rotation axis 56. The third drive roller 46 and the third pinch roller 47 are arranged further such that the original conveyed on the return conveyance path 67 is interposed between the third drive roller 46 and the third pinch roller 47. The third drive roller 46 rotates normally (counterclockwise in FIG. 7) and the original conveyed on the return conveyance path 67 is pushed by the third pinch roller 47 against the third drive roller 46 and accordingly is placed on the stacker placement surface 15 of the stacker 6 in the stacker development area 19.

The conveyance device 31 is configured as described above to convey the original arranged at the top of the originals placed on the tray 3 to the conveyance paths 65 and 66. The conveyance device 31 further conveys the original that is conveyed from the conveyance path 66 to the return conveyance path 67 to the stacker 6 and places the original on the stacker placement surface 15. The surface of the original that is opposed to the tray placement surface 11 when the original is placed on the tray 3 is the back surface of the surface opposed to the stacker placement surface 15 when the original is placed on the stacker placement surface 15 of the stacker 6. The conveyance device 31 further ejects the original conveyed from the conveyance path 66 to the straight conveyance path 68 to the outside of the casing 2. Compared to the straight conveyance path 68, the degree of curve of the return conveyance path 67 is large. For this reason, the degree of deformation of the original passing through the return conveyance path 67 is larger than the degree of deformation of the original passing through the straight conveyance path 68.

The stacker 6 further includes another interlock mechanism (not illustrated in FIG. 7). When the pick roller 41, the first drive roller 42, the second drive roller 44, and the third drive roller 46 rotate normally, the interlock mechanism causes the first stacker member 21 to turn about the rotation axis 16 to be arranged in the stacker development area 19. The interlock mechanism holds the first stacker member 21 such that the first stacker member 21 is arranged in the stacker development area 19 during normal rotation of the pick roller 41, the first drive roller 42, the second drive roller 44, and the third drive roller 46. When the pick roller 41, the first drive roller 42, the second drive roller 44, and the third drive roller 46 rotate inversely, the interlock mechanism causes the first stacker member 21 to turn about the rotation axis 16 to be arranged in the stacker storage area 18.

Read Device

The read device 32 is arranged between the conveyance path 65 and the conveyance path 66 in the casing 2. The read device 32 includes a lower image sensor 61 and an upper image sensor 62. The lower image sensor 61 is arranged under the plane along which the conveyance path 65 and the conveyance path 66 are and is fixed to the frame 20. The lower image sensor 61 is formed of an image sensor of a contact image sensor (CIS) type. The lower image sensor 61 contacts a lower read surface of the original conveyed from the conveyance path 65 to the conveyance path 66, which is the surface opposed to the lower image sensor 61, illuminates the lower read surface, and receives the light reflected on the lower read surface, thereby reading the image on the lower read surface. The upper image sensor 62 is arranged above the plane along which the conveyance path 65 and the conveyance path 66 are and is supported on the frame 20 movably in parallel with the vertical direction. The upper image sensor 62 is formed of a CIS-type image sensor. The upper image sensor 62 illuminates an upper read surface of the original that is conveyed from the conveyance path 65 to the conveyance path 66, which is the surface opposed to the upper image sensor 62, and receives the light reflected on the upper read surface, thereby reading the image on the upper read surface.

Figure 8:
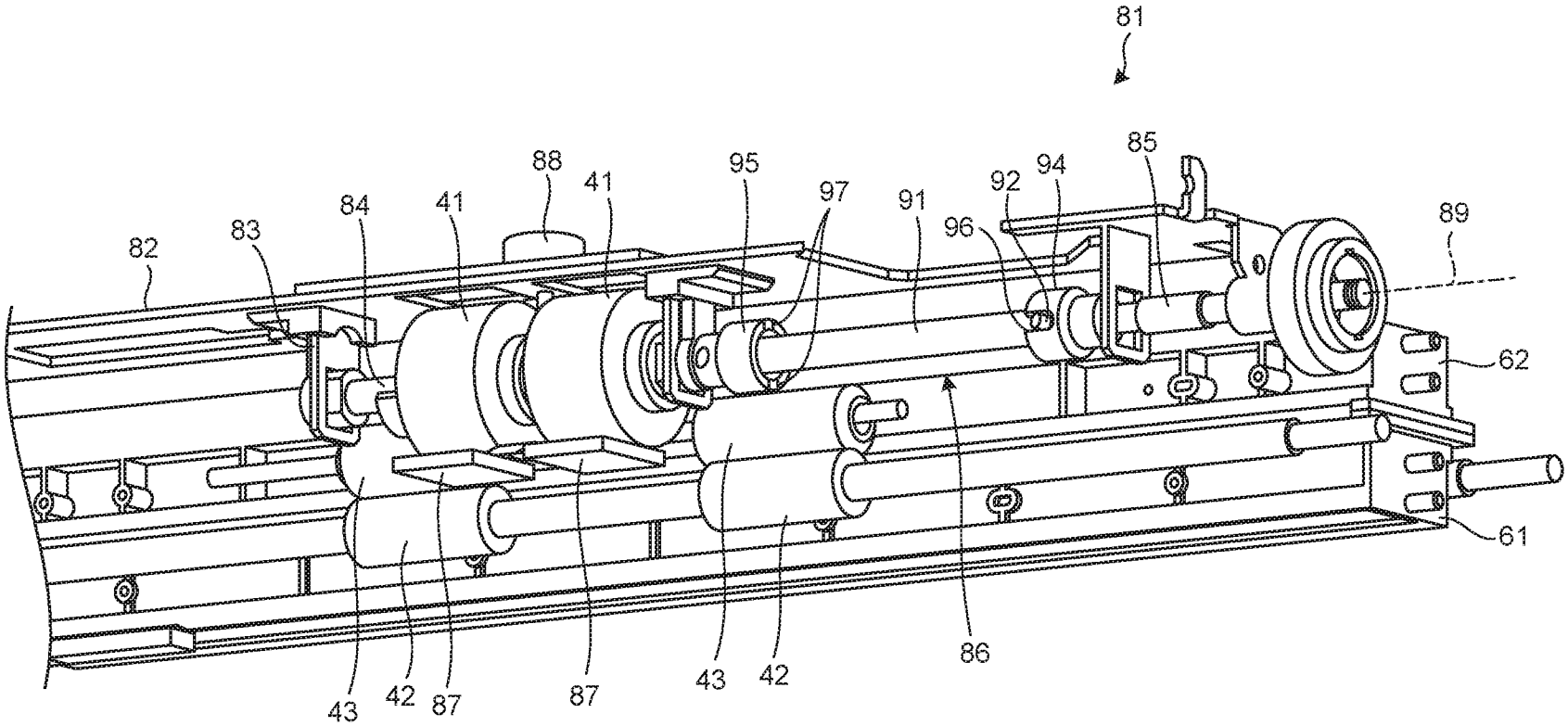
FIG. 8 is a perspective view of a pick unit.
Figure 9:
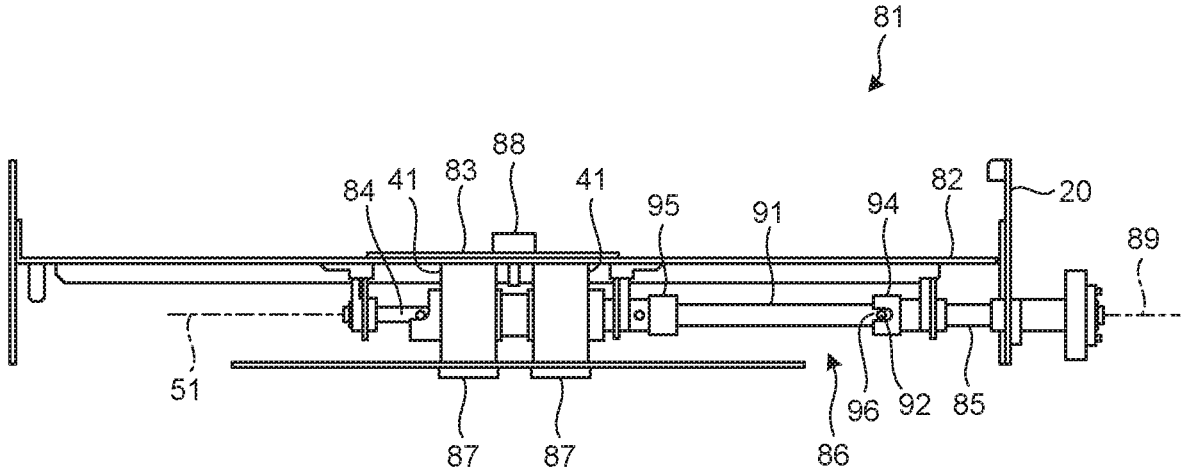
FIG. 9 is a front view of the pick unit.

As illustrated in FIG. 8, the conveyance device 31 further includes a pick unit 81. FIG. 8 is a perspective view of the pick unit 81. FIG. 9 is a front view of the pick unit 81. The pick unit 81 includes a pick frame 82, a guiding member 83, a pick roller shaft 84, a drive shaft 85, a joint unit 86, a pad 87, and a fixation screw 88. The pick frame 82 is formed into a platy shape. The pick frame 82 is arranged above the pick roller 41 in the casing 2 such that the pick frame 82 is along another plane that is parallel with the plane along the conveyance path 65, and the pick frame 82 is fixed to the frame 20.

The guiding member 83 is, as illustrated in FIG. 9, formed of a curved board. The guiding member 83 is supported on the pick frame 82 movably in parallel with a direction that is approximately orthogonal to the plane along the conveyance path 65 such that the guiding member 83 is arranged in a thin original feed position or a thick original feed position. The pick roller shaft 84 is formed into a bar shape. The pick roller shaft 84 is arranged inside the casing 2 along the rotation axis 51 and is supported on the guiding member 83 rotatably about the rotation axis 51. The pick roller 41 is fixed to the pick roller shaft 84 and thus is supported on the guiding member 83 rotatably about the rotation axis 51. In other words, the guiding member 83 moves in parallel with the pick frame 82 and accordingly the pick roller 41 moves in parallel with the frame 20.

The drive shaft 85 is supported on the frame 20 rotatably about a rotation axis 89. The rotation axis 89 is parallel with the rotation axis 51 and is fixed to the frame 20. The joint unit 86 includes a joint shaft 91, a first parallel pin 92, a first bearing member 94, and a second bearing member 95. The joint shaft 91 is formed into a bar shape. The first parallel pin 92 is formed into a bar shape thinner than the joint shaft 91. The first parallel pin 92 is arranged to intersect with one end of the joint shaft 91 and is fixed to the joint shaft 91. A straight line along which the first parallel pin 92 is orthogonal to a straight line along which the joint shaft 91 is.

The first bearing member 94 is formed into an approximately cylindrical shape and is fixed to one end of the drive shaft 85. In the first bearing member 94, cutouts 96 in a pair are formed. The cutouts 96 in a pair are formed to be opposed to each other and are formed along a straight line that is parallel with the rotation axis 89. One end of the joint shaft 91 is deeply in the first bearing member 94 such that both ends of the first parallel pin 92 are fitted into the first cutouts 96 in a pair, respectively. Both ends of the first parallel pin 92 are fitted to the first cutouts 96 in a pair and thus the joint shaft 91 is movable along another straight line oblique to the rotation axis 89. Both ends of the first parallel pin 92 are fitted to the first cutouts 96, respectively, and accordingly, when the drive shaft 85 rotates, rotation force is transmitted from the drive shaft 85 via the first bearing member 94 to the joint shaft 91 and accordingly the joint shaft 91 rotates together with the drive shaft 85. In other words, the first bearing member 94 connects the drive shaft 85 and the joint shaft 91 such that, even when the straight line along which the drive shaft 85 is oblique to the straight line along which the joint shaft 91 is, rotation force is transmitted from the drive shaft 85 to the joint shaft 91.

As the first bearing member 94 does, the second bearing member 95 connects the pick roller shaft 84 and the joint shaft 91. In other words, the joint unit 86 further includes a second parallel pin (not illustrated in FIG. 9). The second parallel pin is formed into a bar shape that is thinner than the joint shaft 91. The second parallel pin is arranged to intersect with the other end of the joint shaft 91 that is opposite to the end of the joint shaft 91 where the first parallel pin 92 is arranged, and the second parallel pin is fixed to the joint shaft 91. A straight line along which the second parallel pin is orthogonal to the straight line along which the joint shaft 91 is and is orthogonal to the straight line along which the first parallel pin 92 is. The second bearing member 95 is formed into an approximately cylindrical shape and is fixed to one end of the pick roller shaft 84. In the second bearing member 95, as illustrated in FIG. 8, second cutouts 97 in a pair are formed. The second cutouts 97 in a pair are formed to be opposed to each other and each of the second cutouts 97 is formed along a straight line along the rotation axis 51. The other end of the joint shaft 91 on the side opposite to the end of the joint shaft 91 where the first parallel pin 92 is arranged is deeply in the second bearing member 95 such that both ends of the second parallel pin are fitted to the second cutouts 97 in a pair. Both ends of the second parallel pin are fitted respectively to the second cutouts 97 and thus both ends of the second parallel pin are guided to move along the second cutouts 97 in a pair, respectively, and thus the second parallel pin is supported on the second bearing member 95 rotatably about the axis of the second parallel pin. Both ends of the second parallel pin are fitted respectively to the second cutouts 97 in a pair and thus the joint shaft 91 is movable along another straight line oblique to the rotation axis 51. Both the ends of the second parallel pin are fitted respectively to the second cutouts 97 in a pair and thus, when the joint shaft 91 rotates, a rotation force is transmitted to the pick roller shaft 84 from the joint shaft 91 via the second bearing member 95 and accordingly the pick roller shaft 84 rotates together with the joint shaft 91.

In other words, in both cases where the rotation axis 51 and the rotation axis 89 coincide and where the rotation axis 51 and the rotation axis 89 do not coincide, the joint unit 86 transmits rotation of the drive shaft 85 to the pick roller 41. Transmission of rotation of the drive shaft 85 via the joint unit 86 may cause the pick roller 41 to rotate at another rotation rate different from the rotation rate of the drive shaft 85 and thus, even when the drive shaft 85 rotates at an a constant rate, the rotation rate of the pick roller 41 may vary.

The pad 87 is formed into a platy shape. The pad 87 is formed such that a force of friction that occurs between the pad 87 and the original is smaller than a force of friction that occurs between the pick roller 41 and the original. The pad 87 is arranged under the pick roller 41 in the casing 2 such that the pad 87 is opposed to the pick roller 41 via a plane connecting the tray placement surface 11 of the tray 3 and the conveyance path 65, and the pad 87 is fixed to the frame 20. The pad 87 is arranged such that, when the guiding member 83 is arranged in the thin original feed position, the pad 87 contacts the pick roller 41.

Figure 10:
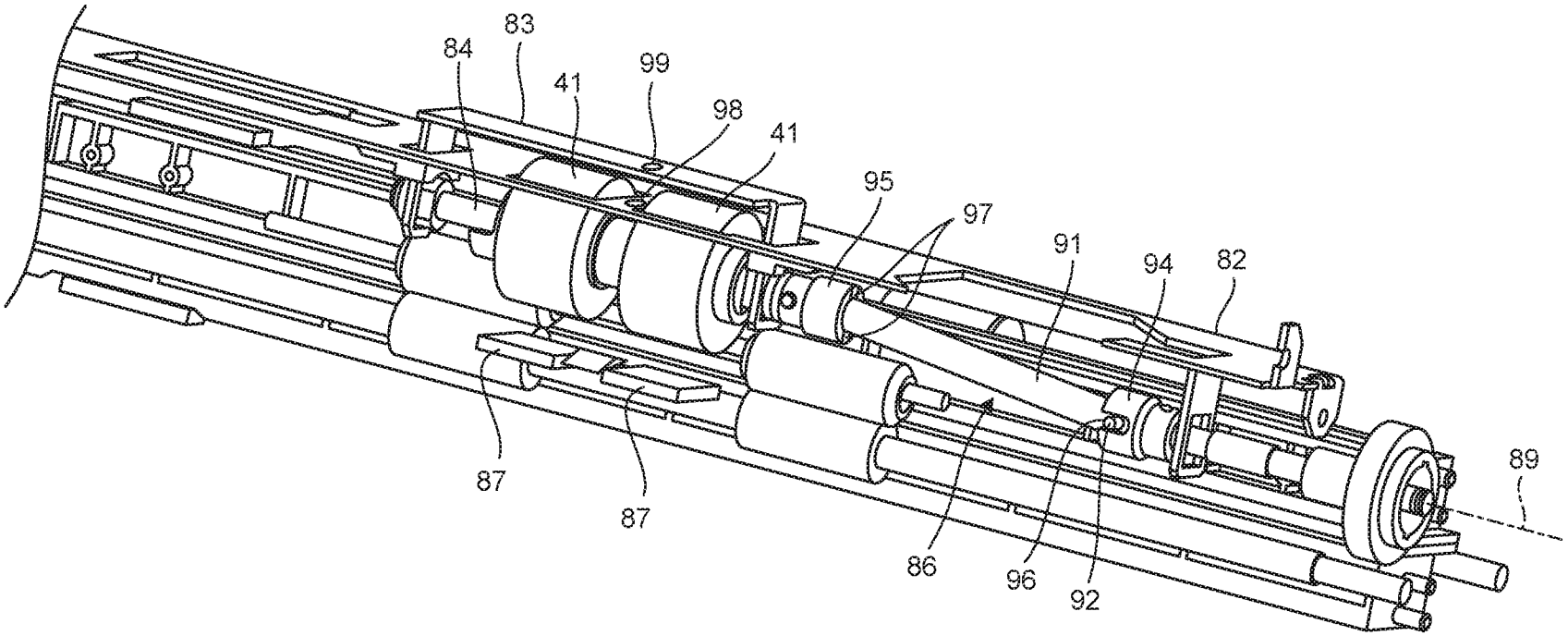
FIG. 10 is a perspective view of the pick unit in the case where a fixation screw is detached.

The fixation screw 88 is operated by a user to be attached to the pick unit 81 or detached from the pick unit 81. FIG. 10 is a perspective view of the pick unit 81 in the case where the fixation screw 88 is detached. As illustrated in FIG. 10, a female screw 98 is formed in the pick frame 82. A through-hole 99 is formed in the guiding member 83. The fixation screw 88 is fastened to the female screw 98 in the pick frame 82 via the through-hole 99 in the guiding member 83 and accordingly is attached to the pick unit 81. The fixation screw 88 is fastened to the female screw 98 in the pick frame 82 and thus fixes the guiding member 83 to the pick frame 82 such that the guiding member 83 is arranged in the thin original feed position. When the fixation screw 88 is detached from the pick frame 82, the guiding member 83 is unfixed.

Figure 11:
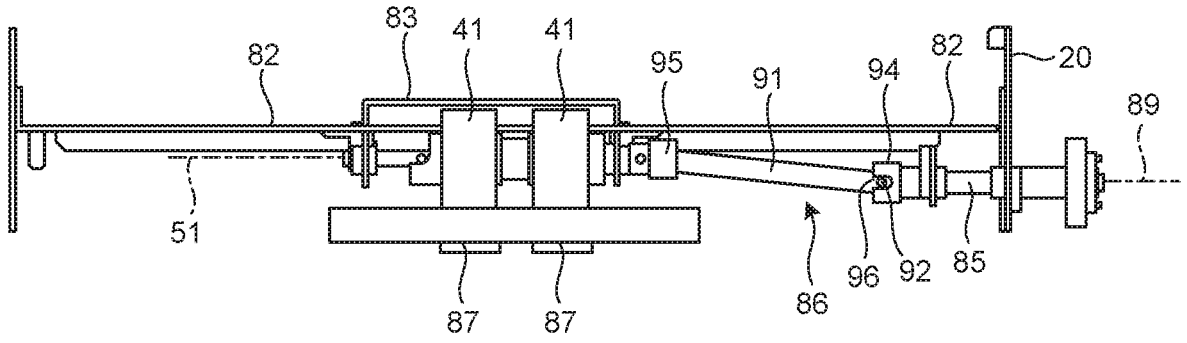
FIG. 11 is a front view of the pick unit in the case where a guiding member is arranged in a thick original feed position.

FIG. 11 is a front view of the pick unit 81 in the case where the guiding member 83 is arranged in the thick original feed position. When the fixation screw 88 is detached from the pick frame 82, the pick roller 41 moves away from the pad 87 and accordingly, as illustrated in FIG. 11, the guiding member 83 moves from the thin original feed position to the thick original feed position. In other words, when the fixation screw 88 is detached from the pick frame 82, a thick original is interposed between the pick roller 41 and the pad 87 and accordingly the guiding member 83 is arranged in the thick original feed position.

Figure 12:
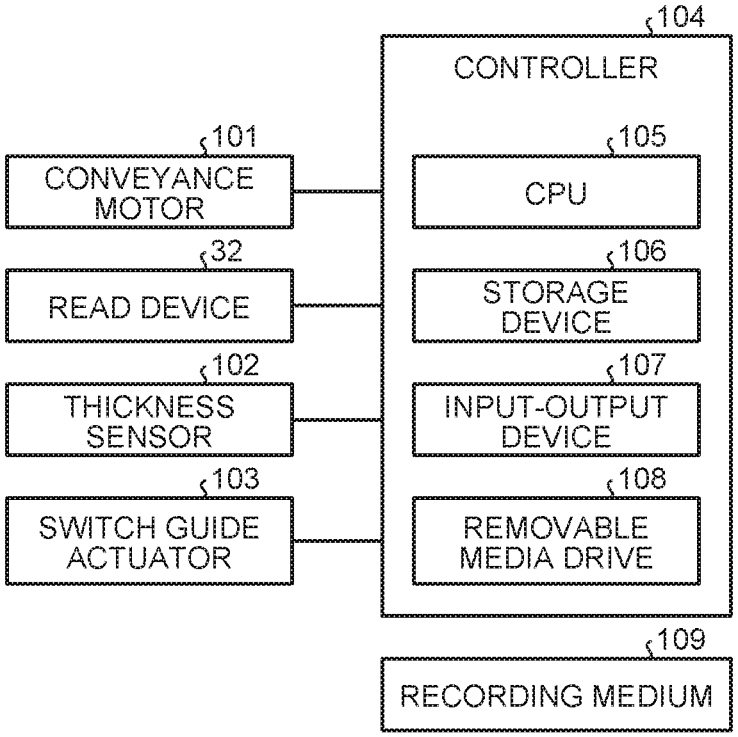
FIG. 12 is a block diagram of the medium conveyance device of the first embodiment.

FIG. 12 is a block diagram of the medium conveyance device 1 of the first embodiment. As illustrated in FIG. 12, the medium conveyance device 1 further includes a conveyance motor 101, a thickness sensor 102, a switch guide actuator 103, and a controller 104. The conveyance motor 101 is controlled by the controller 104 and thus causes the first drive roller 42, the second drive roller 44, the third drive roller 46, and the drive shaft 85 to rotate normally or inversely. The thickness sensor 102 is controlled by the controller 104 and thus measures the thickness of the original conveyed on the conveyance path 65. The switch guide actuator 103 is controlled by the controller 104 and thus arranges the switch guide 38 in the return path guide position or the straight-path guide position.

The controller 104 is a computer and includes a central processing unit (CPU) 105, a storage device 106, an input-output device 107, and a removable media drive 108. The CPU 105 executes a computer program that is installed in the controller 104 to perform information processing and control the storage device 106, the input-output device 107, and the removable media drive 108. The CPU 105 executes the computer program to further control the conveyance motor 101, the read device 32, the thickness sensor 102, and the switch guide actuator 103. The storage device 106 records the computer program and records information that is used by the CPU 105. It is possible to use, as the storage device 106, for example, any one, some, or all of a memory, such as a RAM or a ROM, a fixed disk device, such as a hard disk, a solid state drive (SSD) and an optical disk. The input-output device 107 is, for example, a touch panel and outputs information that is generated by operation performed by the user on the input-output device 107 to the CPU 105 and outputs information that is generated by the CPU 105 such that the information is recognizable by the user. The removable media drive 108 is formed such that a non-transitory and tangible recording medium 109 is mountable. A memory card, a USB memory, a SD card, a flexible disk, a magneto-optical disc, a ROM, a EPROM, a EEPROM, a CD-ROM, a MO, a DVD, a blu-ray (trademark) disc, etc., are exemplified as the recording medium 109. When the recording medium 109 is mounted on the removable media drive 108, the removable media drive 108 is controlled by the CPU 105 and thus reads the information that is stored in the recording medium 109. The computer program that is installed in the controller 104 may be information that is read from the recording medium 109 via the removable media drive 108.

The controller 104 controls the conveyance motor 101 such that the originals placed on the tray 3 are conveyed to the conveyance path 65, the conveyance path 66, the return conveyance path 67, and the straight conveyance path 68. Specifically, the controller 104 controls the conveyance motor 101 such that the drive shaft 85 is caused to rotate normally and accordingly one of the originals placed on the tray 3 that is arranged at the top is fed by the pick roller 41 to the conveyance path 65. The controller 104 controls the conveyance motor 101 such that the first drive roller 42 is caused to rotate normally at a constant speed and accordingly the original conveyed on the conveyance path 65 is conveyed between the lower image sensor 61 and the upper image sensor 62 at a constant speed. The controller 104 controls the conveyance motor 101 such that the second drive roller 44 is caused to rotate normally and accordingly the original conveyed on the conveyance path 66 is conveyed to the return conveyance path 67 or the straight conveyance path 68. The controller 104 controls the conveyance motor 101 such that the third drive roller 46 is caused to rotate normally and the original conveyed on the return conveyance path 67 is placed on the stacker 6.

The controller 104 controls the read device 32 such that the image on the original conveyed between the lower image sensor 61 and the upper image sensor 62 is read. Specifically, the controller 104 controls the lower image sensor 61 such that the image on the lower read surface of the original conveyed between the lower image sensor 61 and the upper image sensor 62 is read. The controller 104 controls the upper image sensor 62 such that the image on the upper read surface of the original conveyed between the lower image sensor 61 and the upper image sensor 62 is read. The controller 104 further records the image on the lower read surface and the image on the upper read surface in the storage device 106. The controller 104 further performs image processing on the image on the lower read surface and the image on the upper read surface and records the processed images in the storage device 106.

The controller 104 controls the thickness sensor 102 such that the thickness of the original conveyed on the conveyance path 65 is measured. Based on the thickness of the original that is measured by the thickness sensor 102, the controller 104 controls the switch guide actuator 103 such that the switch guide 38 is arranged in any one of the return path guide position and the straight path guide position. In other words, the controller 104 controls the switch guide actuator 103 such that, when the thickness of the original that is measured by the thickness sensor 102 is under a given threshold, the switch guide 38 is arranged in the return path guide position. The controller 104 controls the switch guide actuator 103 such that, when the thickness of the original measured by the thickness sensor 102 is above the threshold, the switch guide 38 is arranged in the straight path guide position.

The CPU 105 may be configured of another tangible controller that overall controls the controller 104. A graphics processing unit (GPU), a digital signal processor (DSP), a large scale integration (LSI), an application specific integrated circuit (ASIC), or a field-programmable gate array (FPGA) is exemplified as the tangible controller.

Operations of Conveyance Device 1 of First Embodiment

To read an image on an original with the medium conveyance device 1, first of all, a user moves the first tray member 25 to the tray development position such that the tray 3 is developed. When the first tray member 25 moves to the tray development position, the interlock mechanism of the tray 3 causes the tray 3 to extend. In other words, when the first tray member 25 moves to the tray development position, the interlock mechanism of the tray 3 causes the second tray member 26 to move to the extension position. When the second tray member 26 moves to the extension position, the interlock mechanism of the tray 3 causes the third tray member 27 to move to the extension position. After the tray 3 develops and extends, the user places originals on the tray placement surface 11 of the tray 3.

When a thin original or a plurality of thin originals are placed on the tray 3, the fixation screw 88 is attached to the pick unit 81 and the fixation screw 88 is fastened to the pick frame 82. Paper is exemplified as the thin originals. The fixation screw 88 is fastened to the pick frame 82 and thus the guiding member 83 is arranged in the thin original feed position and is fixed to the pick frame 82.

When a plurality of originals including a thick original or a thick original is placed on the tray 3, the user detaches the fixation screw 88 from the pick unit 81. A booklet or a plastic card is exemplified as the thick original. A passbook or a passport is exemplified as the booklet. A credit card or a cash card is exemplified as the plastic card. The fixation screw 88 is detached from the pick unit 81 and accordingly the guiding member 83 can be arranged in the thin original feed position or the thick original feed position without being fixed to the pick frame 82.

The user starts the medium conveyance device 1 after fastening the fixation screw 88 to the pick frame 82 or detaching the fixation screw 88 from the pick unit 81. Once the medium conveyance device 1 is started, the controller 104 controls the conveyance motor 101, thereby causing the drive shaft 85, the first drive roller 42, the second drive roller 44, and the third drive roller 46 to rotate normally. When the drive shaft 85, the first drive roller 42, the second drive roller 44, and the third drive roller 46 rotate normally, the stacker 6 develops and extends.

When the drive shaft 85 rotates normally, the rotational power is transmitted from the drive shaft 85 to the pick roller 41 via the joint unit 86 and accordingly the pick roller 41 rotates normally. The pick rocker 41 rotates normally and accordingly the original that is placed on the tray 3 moves toward the conveyance path 65. The original moves to the conveyance path 65 and accordingly is interposed between the pick roller 41 and the pad 87. The pad 87 pushes the original against the pick roller 41 because of the force of gravity applied to the pick roller 41 and the guiding member 83. When the pick roller 41 causes a plurality of originals to move to the conveyance path 65, the pad 87 prevents the original different from the original contacting the pick roller 41 among the originals by the force of friction occurring between the pad 87 and the original. In other words, the pad 87 separates one of the originals contacting the pick roller 41 from other originals. The pad 87 further slides on the back surface of one original that is fed by the pick roller 41, which is the back surface contacting the pick roller 41. As described above, the pick roller 41 rotates normally and accordingly feeds the originals placed on the tray 3 one by one from the tray 3 to the conveyance path 65.

When the pick roller 41 feeds the original to the conveyance path 65, a gap corresponding to the thickness of the original is formed between the pick roller 41 and the pad 87. The gap is formed because, when the guiding member 83 is fixed to the pick frame 82, the pick roller 41, the guiding member 83, and the pad 87 elastically deforms. The gap is formed because, when the guiding member 83 is not fixed to the pick frame 82, the guiding member 83 moves.

The thin original is thinner than a maximum width of the gap that is formed by the elastic deformation and thus, even when the guiding member 83 is fixed to the pick frame 82, the thin original can slip into the interspace between the pick roller 41 and the pad 87. It is difficult for a thick original that is thicker than the maximum width of the gap that is formed because the pick roller 41, the guiding member 83, and the pad 87 deform elastically to slip into the interspace between the pick roller 41 and the pad 87 with the guiding member 83 being arranged in the thin original feed position. When the guiding member 83 is not fixed to the pick frame 82, the pick roller 41 moves apart from the pad 87 and accordingly the thick original can smoothly slip into the interspace between the pick roller 41 and the pad 87. In other words, when the guiding member 83 is not fixed to the pick frame 82, the thick original slips into the interspace between the pick roller 41 and the pad 87 and accordingly the thick original can be appropriately fed out of the tray 3 to the conveyance path 65.

The original that is fed to the conveyance path 65 is conveyed on the conveyance path 65 such that the original is interposed between the first drive roller 42 and the first pinch roller 43. The first drive roller 42 rotates normally at a constant rate and thus, when the original is interposed between the first drive roller 42 and the first pinch roller 43, conveys the original at a constant rate to the conveyance path 65 to supply the original to the read device 32. The rate at which the pick roller 41 feeds the original may vary because the rotation rate of the pick roller 41 varies. The first drive roller 42 rotates normally at a constant rate and thus is able to, even when the rate at which the pick roller 41 feeds an original varies, convey the original such that the original is conveyed at a constant rate between the lower image sensor 61 and the upper image sensor 62.

The original that is supplied to the read device 32 is guided by the lower image sensor 61 and the upper image sensor 62 and is conveyed between the lower image sensor 61 and the upper image sensor 62. When the original is conveyed between the lower image sensor 61 and the upper image sensor 62, the controller 104 reads the image on the lower read surface of the original by controlling the lower image sensor 61 and reads the image on the upper read surface of the original by controlling the upper image sensor 62.

The original that s conveyed between the lower image sensor 61 and the upper image sensor 62 is supplied to the conveyance path 66. The original that is supplied to the conveyance path 66 is pushed by the second pinch roller 45 against the second drive roller 44 and is conveyed on the conveyance path 66 because the second drive roller 44 rotates normally.

When the original is conveyed on the conveyance path 65, the controller 104 controls the thickness sensor 102 to measure a thickness of the original. When the thickness of the original is under the given threshold, the controller 104 controls the switch guide actuator 103, thereby arranging the switch guide 38 in the return path guide position. When the thickness of the original is above the given threshold, the controller 104 controls the switch guide actuator 103, thereby arranging the switch guide 38 in the straight path guide position. When arranged in the return path guide position, the switch guide 38 guides the original conveyed on the conveyance path 66 to the return conveyance path 67. The original guided to the return conveyance path 67 is pushed by the third pinch roller 47 against the third drive roller 46, is conveyed on the return conveyance path 67 because the third drive roller 46 rotates normally, and then is placed on the stacker placement surface 15 of the stacker 6. When arranged in the straight path guide position, the switch guide 38 guides the original conveyed on the conveyance path 66 to the straight conveyance path 68. The original guided to the straight conveyance path 68 is ejected to the outside of the casing 2.

When all the originals placed on the tray 3 are ejected, the controller 104 controls the conveyance motor 101, thereby causing the drive shaft 85, the first drive roller 42, the second drive roller 44, and the third drive roller 46 to rotate inversely. The drive shaft 85, the first drive roller 42, the second drive roller 44, and the third drive roller 46 rotate inversely and accordingly the stacker 6 contracts and then is stored in the stacker storage area 18.

A thin original has flexibility and thus tends not to have curvature even when conveyed on the return conveyance path 67 and paper jamming tends not to occur on the return conveyance path 67. A thick original tends to have curvature when conveyed on the return conveyance path 67 or paper jamming tends to occur on the return conveyance path 67. Because of such tendency, in the medium conveyance device 1, ejection of a thick original via the straight conveyance path 68 without conveyance of the thick original on the return conveyance path 67 tends not to cause curvature in the thick original and tends not cause paper jamming on the return conveyance path 67.

Figure 13:
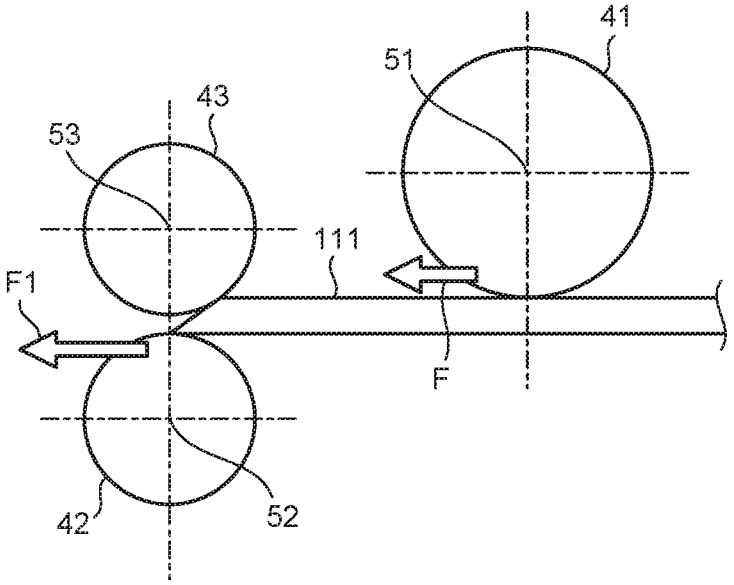
FIG. 13 is a side view of a first drive roller and a first pinch roller in the case where a thick original is fed by the pick roller.

FIG. 13 is a side view of the first drive roller 42 and the first pinch roller 43 in the case where a thick original 111 is fed by the pick roller 41. As illustrated in FIG. 13, the thick original 111 that is fed to the conveyance path 65 contacts the first drive roller 42 and contacts the first pinch roller 43. Right after the thick original 111 contacts the first drive roller 42, the first drive roller 42 rotates normally when the thick original 111 is not interposed between the first drive roller 42 and the first pinch roller 43, thereby conveying the thick original 111 by a feed conveyance force F1. The pick roller 41 rotates normally and thus feeds the thick original 111 to the first drive roller 42 by an auxiliary fore F. When the first pinch roller 43 contacts the thick original 111, the first pinch roller 43 rotates normally because the thick original 111 is conveyed by the feed conveyance force F1 and the auxiliary force F and is pushed up such that the first pinch roller 43 separates from the first drive roller 42. The first pinch roller 43 is pushed up and accordingly the thick original 111 is interposed between the first drive roller 42 and the first pinch roller 43 and is pushed by the first pinch roller 43 against the first drive roller 42. When the first pinch roller 43 pushes the thick original 111 against the first drive roller 42, the first drive roller 42 rotates normally at a constant rate, thereby conveying the thick original 111 to the conveyance path 65 at a constant rate and supplying the thick original ill to the read device 32. When the thick original 111 is interposed between the first drive roller 42 and the first pinch roller 43, the first drive roller 42 rotates normally and accordingly conveys the thick original 111 by a feed conveyance force larger than the feed conveyance force F1.

The rotation rate of the pick roller 41 may vary even when the drive shaft 85 rotates at a constant rate, because the rotation force is transmitted from the drive shaft 85 to the pick roller 41 via the joint unit 86. The larger that distance between the first drive axis 51 and the rotation axis 89 is, the larger the degree of variation is. In other words, compared to the case where a thin original is fed, the degree at which the rotation rate of the pick roller 41 varies in the case where the thick original 111 is conveyed is large. The first drive roller 42 is caused by the conveyance motor 101 to rotate normally at the constant rate and thus, even when the rate at which the thick original 111 is fed by the pick roller 41 varies, is able to convey the thick original 111 at a constant rate on the conveyance path 65. The first drive roller 42 conveys the thick original 111 at the constant rate and thus the lower image sensor 61 and the upper image sensor 62 are able to appropriately read the lower read surface and the upper read surface of the thick original 111, respectively.

Effect of Medium Conveyance Device 1 of First Embodiment

The medium conveyance device 1 of the first embodiment includes the guiding member 83, the pick roller 41, and the joint unit 86. The guiding member 83 is movably supported on the pick frame 82. The pick roller 41 is rotatably supported on the guiding member 83 and rotates to feed the original that is placed on the tray 3 to the first drive roller 42. The joint unit 86 transmits rotation force from the drive shaft 85 to the pick roller 41.

In the medium conveyance device 1, the pick roller 41 that feeds originals is formed movably and thus it is possible to arrange the pick roller 41 in a position corresponding to the thickness of the original. In the medium conveyance device 1, the pick roller 41 is arranged in a position corresponding to the thickness of the original and accordingly it is possible to appropriately feed both thin originals and thick originals from the tray 3 to the conveyance path 65. In the medium conveyance device 1, furthermore, even when the rate at which the pick roller 41 feeds originals varies, the first drive roller 42 conveys originals that are fed by the pick roller 41 and thus it is possible to reduce variation in conveyance rate at which originals are conveyed. When the medium conveyance device 1 is used for an image read device, by reducing variation in conveyance rate at which originals are conveyed, it is possible to appropriately read both thin originals and thick originals.

The medium conveyance device 1 of the first embodiment further includes the fixation screw 88. The fixation screw 88 is attached to the pick unit 81 and detached from the pick unit 81. The guiding member 83 is fixed to the pick frame 82 when the fixation screw 88 is attached to the pick unit 81 and the guiding member 83 is supported on the pick frame 82 such that the guiding member 83 is movable when the fixation screw 88 is detached from the pick unit 81. In the medium conveyance device 1, when a thin original is fed from the tray 3, the guiding member 83 is fixed in the thin original feed position and this prevents the guiding member 83 from moving to the thick original feed position and thus it is possible to appropriately feed a thin original.

The fixation screw 88 of the medium conveyance device 1 of the first embodiment can be attached to the pick unit 81 and detached from the pick unit 81. The fixation screw 88 may be replaced with another switch unit that cannot be detached from the pick unit 81.

Second Embodiment

Figure 14:
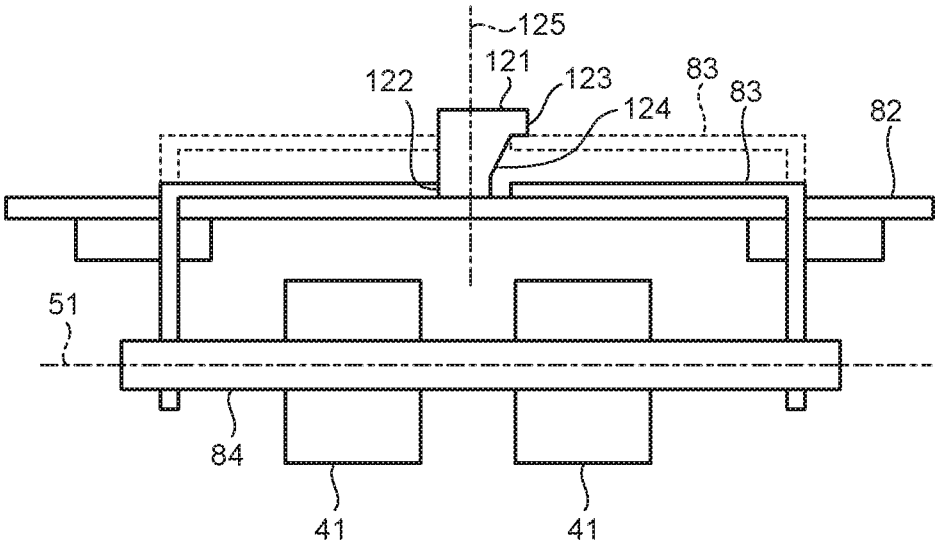
FIG. 14 is a front view of a pick unit of a medium conveyance device of a second embodiment.
Figure 15:
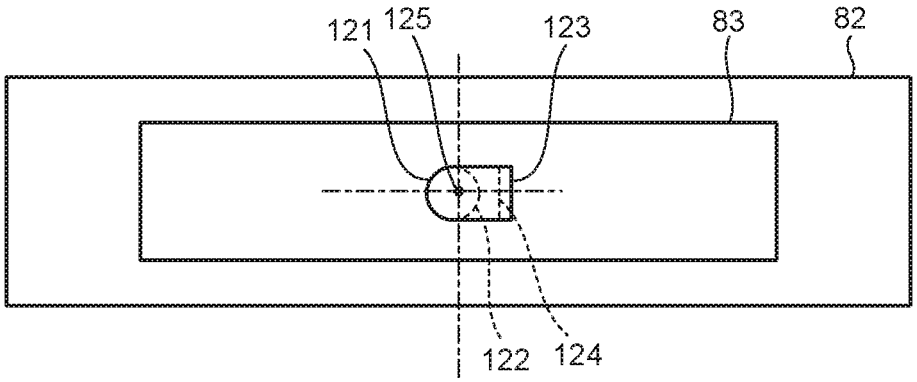
FIG. 15 is a plane view of the pick unit of the medium conveyance device of the second embodiment.

FIG. 14 is a front view of a pick unit of a medium conveyance device of a second embodiment. FIG. 15 is a plane view of the pick unit of the medium conveyance device of the second embodiment. As illustrated in FIG. 14, the medium conveyance device of the second embodiment is obtained by replacing the fixation screw 88 of the medium conveyance device 1 of the first embodiment with a fixation lever 121. The fixation lever 121 is supported on the pick frame 82 rotatably about a rotation axis 125 such that the fixation lever 121 is arranged in a fixation position or a movability position. The rotation axis 125 is parallel with a direction in which the guiding member 83 is movable, that is, orthogonal to a plane along which the conveyance path 65 is. The fixation lever 121 includes a shaft 122, a first stopper 123, and a second stopper 124. The shaft 122 is formed cylindrically and is arranged along the rotation axis 125. The first stopper 123 is formed to protrude from a side surface of a top end of the shaft 122. The second stopper 124 is formed such that the second stopper 124 protrudes from the side surface of the center of the shaft 122. The level at which the second stopper 124 protrudes is lower than the level at which the first stopper 123 protrudes.

In the guiding member 83, a cutout 126 is formed. The cutout 126 is formed to penetrate through the guiding member 83 and is formed such that the shaft 122 of the fixation lever 121 is arranged in the cutout 126. The fixation lever 121 is formed such that, when the guiding member 83 is arranged in the thin original feed position, the first stopper 123 and the second stopper 124 are not arranged in the cutout 126. The cutout 126 is formed further such that the first stopper 123 of the fixation lever 121 does not enter the cutout 126, that is, the fixation lever 121 does not pass through the cutout 126. The cutout 126 is formed further such that, in the case where the fixation lever 121 is arranged in the movability position, when the guiding member 83 is arranged in the thick original feed position, the second stopper 124 enters the cutout 126. In other words, when the fixation lever 121 is arranged in the movability position, the second stopper 124 enters the cutout 126 or goes out of the cutout 126 and accordingly the guiding member 83 can be arranged in the thin original feed position or the thick original feed position.

Figure 16:
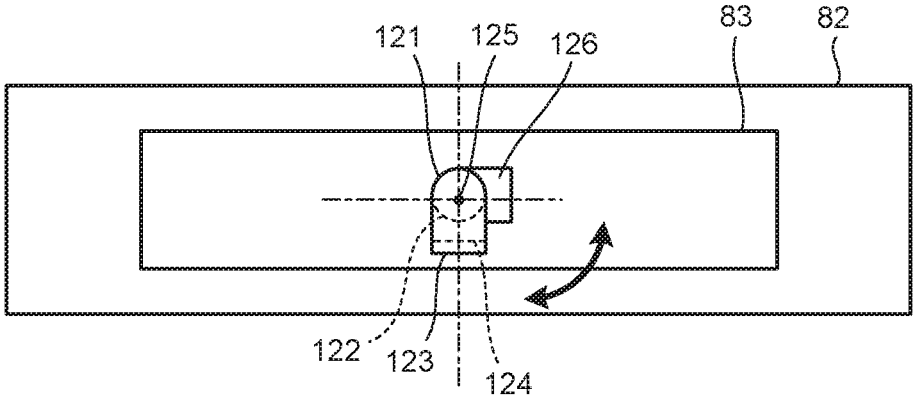
FIG. 16 is a front view of the pick unit of the medium conveyance device of the second embodiment in the case where a fixation lever is arranged in a fixation position.
Figure 17:
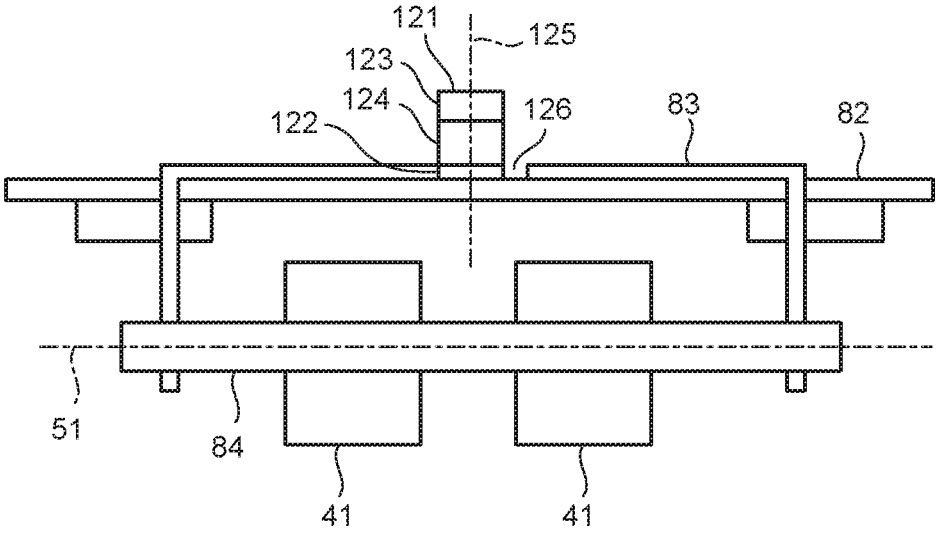
FIG. 17 is a plane view of the pick unit of the medium conveyance device of the second embodiment in the case where the fixation lever is arranged in the fixation position.

FIG. 16 is a front view of the pick unit of the medium conveyance device of the second embodiment in the case where the fixation lever 121 is arranged in the fixation position. FIG. 17 is a plane view of the pick unit of the medium conveyance device of the second embodiment in the case where the fixation lever 121 is arranged in the fixation position. As illustrated in FIG. 16, when the guiding member 83 is arranged in the thin original feed position, the fixation lever 121 is rotated about the rotation axis 125 to move from the movability position to the fixation position. The cutout 126 is formed such that, as illustrated in FIG. 17, when the fixation lever 121 is arranged in the fixation position, the second stopper 124 does not enter the cutout 126. When the guiding member 83 is arranged in the thin original feed position, the fixation lever 121 is arranged in the fixation position and accordingly the guiding member 83 is engaged with the second stopper 124 and is fixed to the pick frame 82.

When one thin original or a plurality of thin originals are placed on the tray 3, the user arranges the fixation lever 121 in the fixation position and thus arranges the guiding member 83 in the thin original feed position and fix the guiding member 83 to the pick frame 82. When a plurality of originals including a thick original or a thick original is arranged on the tray 3, the user arranges the fixation lever 121 in the movability position and thus does not fix the guiding member 83 to the pick frame 82. After arranging the fixation lever 121 in the fixation position or the movability position, the user starts the medium conveyance device of the second embodiment. After started, the medium conveyance device of the second embodiment operates as the above-described medium conveyance device 1 of the first embodiment does.

In the medium conveyance device of the second embodiment, the guiding member 83 is formed movably and thus, as in the above-described medium conveyance device 1 of the first embodiment, the pick roller 41 is arranged in a position corresponding to the thickness of the original and thus it is possible to appropriately feed originals from the tray 3 to the conveyance path 65. In the medium conveyance device of the second embodiment, the fixation lever 121 need not be detached and thus it is unnecessary to keep a place to temporarily store the detached member and thus, compared to the above-described medium conveyance device 1 of the first embodiment, the medium conveyance device of the second embodiment is usable easily.

Effect of Second Embodiment

The medium conveyance device of a second embodiment further includes the fixation lever 121. The fixation lever 121 is arranged in the fixation position or the movability position. The guiding member 83 is fixed to the pick frame 82 when the fixation lever 121 is arranged in the movability position, and the guiding member 83 is supported on the frame 20 movably when the fixation lever 121 is arranged in the movability position. In the medium conveyance device, when a thick original is fed from the tray 3, arranging the fixation lever 121 in the movability position makes it possible to arrange the pick roller 41 in the position corresponding to the thickness of the original and thus appropriately feed the thick original from the tray 3. In the medium conveyance device, when a thin original is fed from the tray 3, fixing the guiding member 83 to the thin original feed position prevents the guiding member 83 from moving to the thick original feed position and thus it is possible to feed the thin original appropriately.

The fixation screw 88 and the fixation lever 121 of the medium conveyance device of the above-described embodiments switch between fixing and unfixing the guiding member 83. The guiding member 83 may be replaced with another switch unit that increases or reduces the area where the guiding member 83 moves.

Third Embodiment

Figure 18:
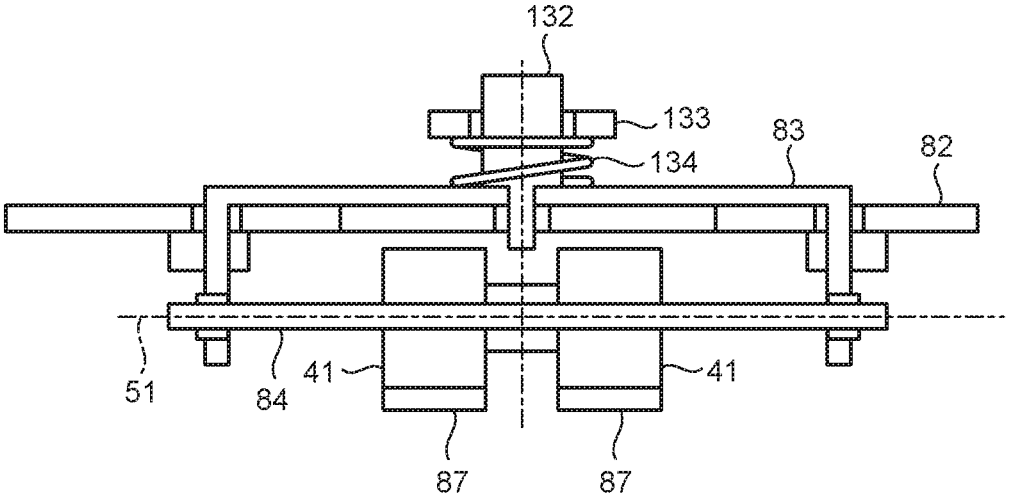
FIG. 18 is a front view of a pick unit of a medium conveyance device of a third embodiment.

As illustrated in FIG. 18, a medium conveyance device of a third embodiment is obtained by omitting the fixation screw 88 from the above-described medium conveyance device 1 of the first embodiment and adding a switch screw 132, a spring fixation member 133, and a spring 134. FIG. 18 is a front view of a pick unit of a medium conveyance device of the third embodiment. The switch screw 132 is fastened to the female screw 98 of the pick frame 82 or is loosened. The spring fixation member 133 is arranged above the guiding member 83 such that the guiding member 83 is arranged between the spring fixation member 133 and the pick frame 82 and is fixed to the pick frame 82. The spring 134 is formed of an elastic body and is arranged between the guiding member 83 and the spring fixation member 133. One end of the spring 134 is pressed firmly against the spring fixation member 133 and the other end of the spring 134 is pressed firmly against the guiding member 83.

The switch screw 132 is fastened to the female screw 98 of the pick frame 82 to reduce a guiding member movability area in which the guiding member 83 is movable, and the switch screw 132 is loosened to increase the guiding member movability area. When the guiding member 83 is arranged in the thin original feed position, the switch screw 132 is fastened to the female screw 98 of the pick frame 82 to fix the guiding member 83 to the pick frame 82. Sufficiently loosening the switch screw 132 unfixes the guiding member 83 from the pick frame 82 and accordingly can be arranged in the thin original feed position or the thick original feed position.

Figure 19:
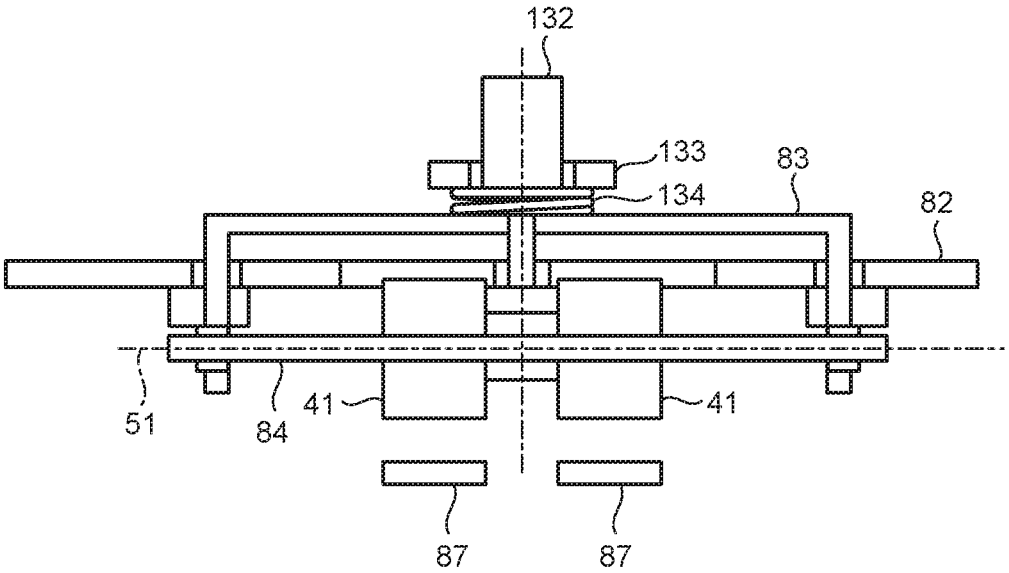
FIG. 19 is a front view of the pick unit of the medium conveyance device of the third embodiment in the case where a guiding member is arranged in the thick original feed position.

FIG. 19 is a front view of the pick unit of the medium conveyance device of the third embodiment in the case where a guiding member 83 is arranged in the thick original feed position. As illustrated in FIG. 19, the guiding member 83 is arranged in the thick original feed position and thus the spring 134 deforms elastically. When the guiding member 83 is arranged in the thick original feed position, the spring 134 applies an elastic force to the guiding member 83 such that the pick roller 41 moves close to the pad 87.

When a thin original or a plurality of thin originals are placed on the tray 3, the user fastens the switch screw 132 to the pick frame 82 to arrange the guiding member 83 in the thin original feed position and fix the guiding member 83 to the pick frame 82. When a plurality of originals including a thick original or a thick original is placed on the tray 3, the user loosens the switch screw 132 from the pick frame 82 to increase the guiding member movability area. After fastening the switch screw 132 to the pick frame 82 or loosening the switch screw 132 from the pick frame 82, the user starts the medium conveyance device of the third embodiment. After started, the medium conveyance device of the third embodiment operates as the medium conveyance device of the above-described first embodiment does.

In the medium conveyance device of the third embodiment, the guiding member 83 is formed movably and thus, as in the medium conveyance device of the above-described first embodiment, the pick roller 41 is arranged in a position corresponding to the thickness of the original and thus it is possible to appropriately feed originals from the tray 3 to the conveyance path 65. In the medium conveyance device of the third embodiment, the spring 134 is provided and thus, even when the switch screw 132 is loosened, it is possible to push the original against the pick roller 41 by the elastic force of the spring 134 and thus feed the original appropriately.

Effect of Conveyance Device of Third Embodiment

The medium conveyance device of the third embodiment includes the switch screw 132 that increases or reduces the guiding member movability area in which the guiding member 83 moves. In the medium conveyance device, when a thick original is fed from the tray 3, increasing the guiding member movability area makes it possible to arrange the pick roller 41 in a position corresponding to the thickness of the original and accordingly appropriately feed thick originals from the tray 3. In the medium conveyance device, when a thin original is fed from the tray 3, reducing the guiding member movability area prevents the guiding member 83 from moving to the thick original feed position and thus it is possible to appropriately feed the thin original appropriately.

The medium conveyance device of the third embodiment further includes the pad 87 and the spring 134. The pad 87 is opposed to the pick roller 41. When an original is interposed between the pad 87 and the pick roller 41, the spring 134 applies an elastic force to the guiding member 83 such that the original is pushed against the pick roller 41. In the medium conveyance device, provision of the spring 134 makes it possible to appropriately push the original against the pick roller 41 via the pad 87. In the medium conveyance device, even when the guiding member 83 is movable, pushing the original against the pick roller 41 by the elastic force of the spring 134 makes it possible to appropriately feed the thick original to the conveyance path 65.

Fourth Embodiment

Figure 20:
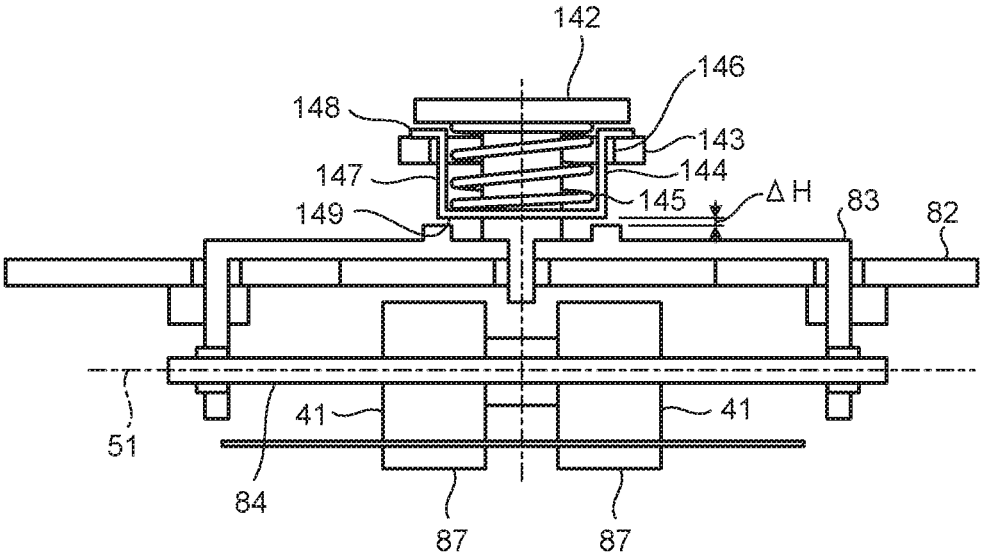
FIG. 20 is a front view of a pick unit of a medium conveyance device of a fourth embodiment.

As illustrated in FIG. 20, a medium conveyance device of a fourth embodiment is obtained by omitting the fixation screw 88 from the above-described medium conveyance device 1 of the first embodiment and adding a switch screw 142, a spring fixation member 143, a spring stopper 144, and a spring 145. FIG. 20 is a front view of a pick unit of the medium conveyance device of the fourth embodiment. The switch screw 142 is fastened to the female screw 98 of the pick frame 82 or is loosened. The switch screw 142 is fastened to the female screw 98 and accordingly is arranged in a fixation position. The switch screw 142 is loosened from the female screw 98 and accordingly is arranged in a movability position. The spring fixation member 143 is arranged above the guiding member 83 such that the guiding member 83 is arranged between the spring fixation member 143 and the pick frame 82 and the spring fixation member 143 is fixed to the pick frame 82. In the spring fixation member 143, a cutout 146 is formed.

The spring stopper 144 includes a body 147, a flange 148, and a bottom part 149. The body 147 is formed cylindrically. The flange 148 is arranged to extend from the top end of the body 147 to the outside and is joined to the top end of the body 147. The bottom part 149 is joined to the bottom end of the body 147 such that the bottom end of the body 147 is sealed. The spring stopper 144 is arranged such that the body 147 is arranged in the cutout 146 of the spring fixation member 143 and such that the flange 148 is arranged above the spring fixation member 143. The flange 148 is hooked on the spring fixation member 143 and thus, when the guiding member 83 is arranged in the thin original feed position, the area in which the spring stopper 144 is able to move is limited such that the spring stopper 144 separates from the guiding member 83 by a given height ΔH or larger.

The spring 145 is formed of an elastic body and is arranged in the body 147 of the spring stopper 144. One end of the spring 145 is pressed firmly against the switch screw 142 and the other end of the spring 145 is pressed firmly against the bottom part 149 of the spring stopper 144. The spring 145 applies an elastic force to the spring stopper 144 such that the flange 148 of the spring stopper 144 moves close to the spring fixation member 143, that is, the spring stopper 144 descends.

Figure 21:
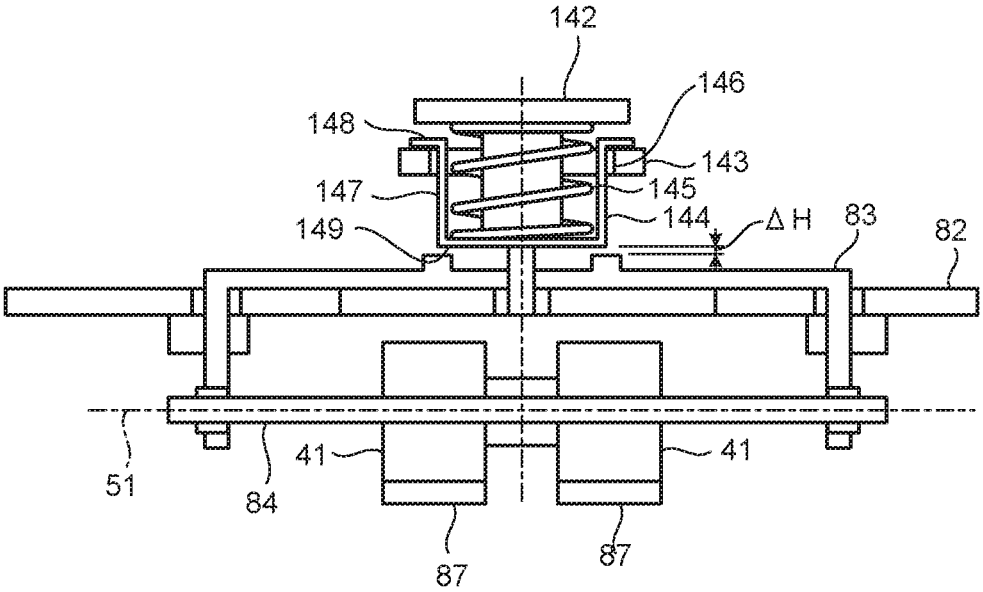
FIG. 21 is a front view of the pick unit of the medium conveyance device of the fourth embodiment in the case where a switch screw is arranged in a movability position.

When the guiding member 83 is arranged in the thin original feed position, the switch screw 142 is arranged in the fixation position and accordingly fixes the guiding member 83 to the pick frame 82. FIG. 21 is a front view of the pick unit of the medium conveyance device of the fourth embodiment in the case where the switch screw 142 is arranged in the movability position. As illustrated in FIG. 21, when the switch screw 142 is arranged in a movability position, the guiding member 83 is unfixed from the pick frame 82 and thus can be arranged in the thin original feed position or the thick original feed position.

When a thin original or a plurality of thin originals are placed on the tray 3, the user arranges the switch screw 142 in the fixation position to arrange the guiding member 83 in the thin original feed position and fix the guiding member 83 to the pick frame 82. When a plurality of originals including a thick original or a thick original is placed on the tray 3, the user arranges the switch screw 142 in the movability position to unfix the guiding member 83 from the pick frame 82. After arranging the switch screw 142 in the fixation position or the movability position, the user starts the medium conveyance device of the fourth embodiment. After started, the medium conveyance device of the fourth embodiment operates as the above-described medium conveyance device of the first embodiment does.

The pick roller 41 rotates normally and accordingly the original placed on the tray 3 slips into the interspace between the pick roller 41 and the pad 87. In the case where the switch screw 142 is arranged in the fixation position, when a thin original slips into the interspace between the pick roller 41 and the pad 87, the pick roller 41 feeds the thin original to the conveyance path 65 with the guiding member 83 being arranged in the thin original feed position. In the case where the switch screw 142 is arranged in the movability position, when a thick original slips into the interspace between the pick roller 41 and the pad 87, the pick roller 41 ascends to cause the guiding member 83 to ascend.

The guiding member 83 ascend by the given height ΔH or more and accordingly is pressed firmly against the bottom part 149 of the spring stopper 144. In other words, when the pick roller 41 and the pad 87 separates with a distance of ΔH or more in between, the guiding member 83 is pressed firmly against the bottom part 149 of the spring stopper 144. After being pressed firmly against the bottom part 149 of the spring stopper 144, the guiding member 83 further ascends, that is, ascends to be by the given level A or more and accordingly is arranged in the thick original feed position.

Figure 22:
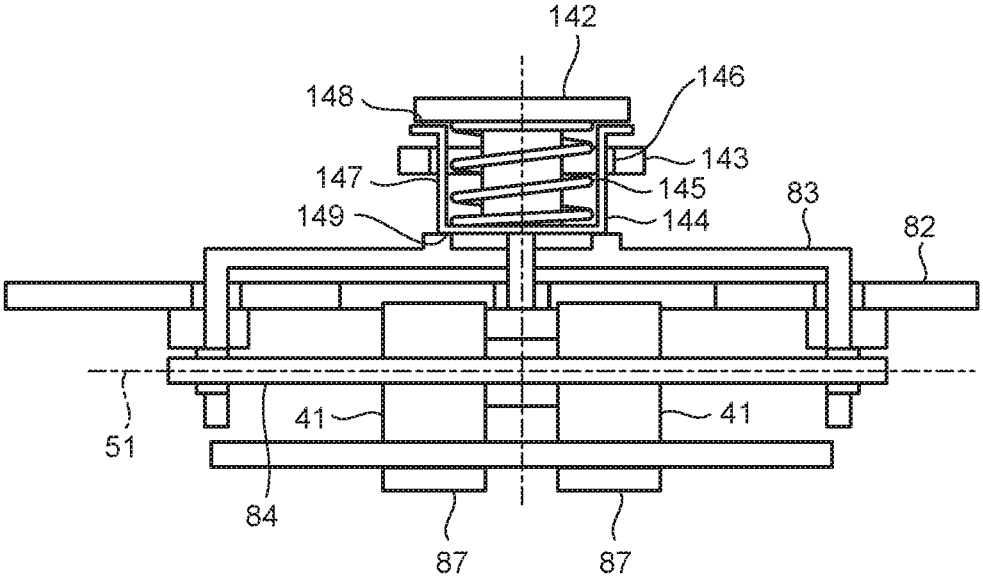
FIG. 22 is a front view of the pick unit of the medium conveyance device of the fourth embodiment in the case where a guiding member is arranged in a thick original feed position.

FIG. 22 is a front view of the pick unit of the medium conveyance device of the fourth embodiment in the case where the guiding member 83 is arranged in the thick original feed position. As illustrated in FIG. 22, the guiding member 83 is arranged in the thick original feed position and accordingly the spring stopper 144 is pushed up by the guiding member 83 such that the flange 148 separates from the spring fixation member 143. The spring stopper 144 moves upward such that the flange 148 separates from the spring fixation member 143 and accordingly the spring 145 deforms elastically. For this reason, when the guiding member 83 is arranged in the thick original feed position, the spring 145 applies an elastic force to the guiding member 83 such that a thick original is pushed against the pick roller 41. In other words, when the pick roller 41 and the pad 87 separates with a distance of ΔH or more in between, the elastic force of the spring 145 is applied to the guiding member 83 such that the original is pushed against the pick roller 41.

Until the guiding member 83 is pressed firmly against the bottom part 149 of the spring stopper 144 from the thin original feed position, the elastic force of the spring 145 is not applied to the guiding member 83 and thus the guiding member 83 is able to ascend by a small force. In other words, in the medium conveyance device of the fourth embodiment, when the switch screw 142 is arranged in the movability position, no elastic force is applied to the pick roller 41 and thus, compared to the medium conveyance device of the third embodiment, a thick original easily slips into the interspace between the pick roller 41 and the pad 87. In the medium conveyance device of the fourth embodiment, a thick original easily slips into the interspace between the pick roller 41 and the pad 87 and thus it is possible to appropriately feed a thick original via the pick roller 41.

Effect of Medium Conveyance Device of Fourth Embodiment

The medium conveyance device of the fourth embodiment further includes the spring stopper 144 that, when the distance between the pick roller 41 and the pad 87 is shorter than the given height ΔH, regulates elastic deformation of the spring 145 such that the elastic force is not applied to the guiding member 83. In the medium conveyance device, the elastic force of the spring 145 is not applied to the guiding member 83 when the distance between the pick roller 41 and the pad 87 is shorter than the height ΔH and thus a thick original easily slips into the interspace between the pick roller 41 and the pad 87. In the medium conveyance device, a thick original easily slips into the interspace between the pick roller 41 and the pad 87 and thus it is possible to appropriately feed a thick original.

The pad 87 of the medium conveyance device of the above-described embodiments is fixed to the frame 20. The pad 87 may be replaced with another separation member that is not fixed to the frame 20.

Fifth Embodiment

Figure 23:
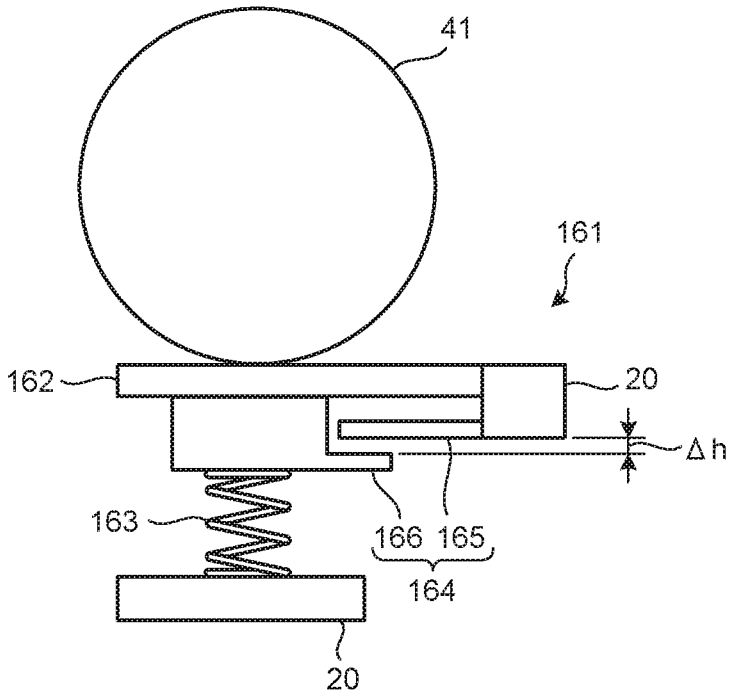
FIG. 23 is a side view of a pad unit of a medium conveyance device of a fifth embodiment.

As illustrated in FIG. 23, a medium conveyance device of a fifth embodiment is obtained by replacing the pad 87 of the medium conveyance device 1 of the above-described second embodiment with a pad 161. FIG. 23 is a side view of the pad 161 of the medium conveyance device of the fifth embodiment. The pad 161 includes a pad 162, a spring 163, and a stopper unit 164. The pad 162 is formed similarly to the above-described pad 87, in other words, is formed into a platy shape and is formed such that a force of friction that occurs between the pad 162 and an original is smaller than a force of friction that occurs between the pick roller 41 and the original. The pad 162 is formed under the pick roller 41 in the casing 2 such that the pad 162 is opposed to the pick roller 41. The pad 162 is supported on part of the frame 20 such that the pad 162 is ascendable and descendible. The spring 163 is formed of an elastic body. One end of the spring 163 is fixed to a surface of the pad 162 on the side opposite to the surface opposed to the pick roller 41 and the other end of the spring 163 is fixed to the frame 20.

The stopper unit 164 includes a first stopper 165 and a second stopper 166. The first stopper 165 is arranged under the pad 162 in the casing 2 and is fixed to the frame 20. The second stopper 166 is arranged under the first stopper 165 and is fixed to the pad 162. The stopper unit 164 is formed such that, when the pad 162 is arranged at a given level, the second stopper 166 is pressed firmly against the first stopper 165. In other words, the stopper unit 164 limits move of the pad 162 such that the pad 162 does not move to the side of the pick roller 41 over the given level.

When the guiding member 83 is arranged in the thin original feed position, the spring 163 is arranged such that the spring 163 contacts the pick roller 41 and accordingly deforms elastically. In other words, when the pad 162 is arranged under the given level, the spring 163 applies an elastic force to the pad 162 such that the pad 162 moves to the side of the pick roller 41. The stopper unit 164 is formed such that the width of the gap between the first stopper 165 and the second stopper 166 is equal to a given height Δh. The given height Δh is smaller than the distance between the thin original feed position and the thick original feed position.

Figure 24:
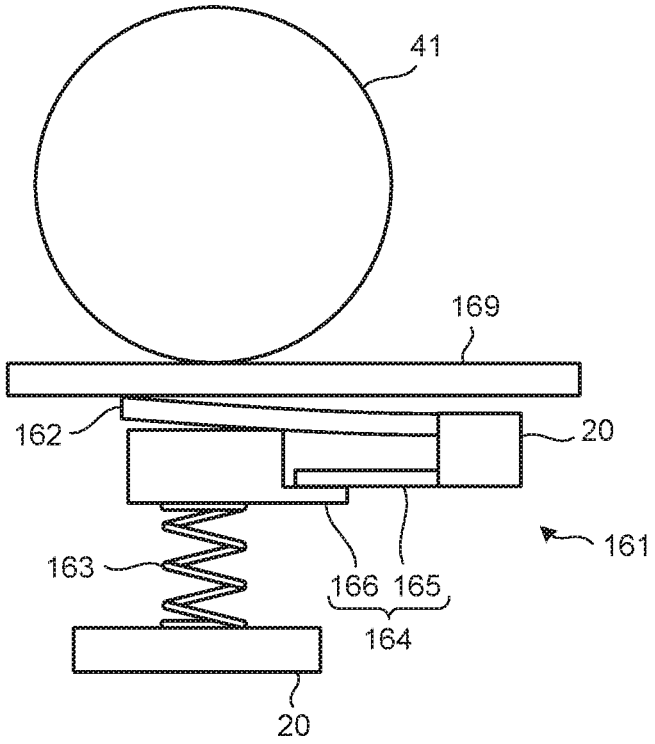
FIG. 24 is a side view of the pad unit of the medium conveyance device of the fifth embodiment in the case where the guiding member is arranged in the thick original feed position.

When the fixation lever 121 is arranged in the movability position, the elastic force of the spring 163 is applied to the pad 162 and accordingly the pad 162 ascends to cause the pick roller 41 to ascend to cause the guiding member 83 to ascend. As illustrated in FIG. 24, the second stopper 166 is pressed firmly against the first stopper 165 and thus the pad 162 is prevented from ascending and the second stopper 166 stops in a position where the second stopper 166 is pressed against the first stopper 165. FIG. 24 is a side view of the pad 161 of the medium conveyance device of the fifth embodiment in the case where the guiding member 83 is arranged in the thick original feed position.

The pick roller 41 rotates normally and accordingly an original that is placed on the tray 3 slips into the interspace between the pick roller 41 and the pad 162. In the case where the fixation lever 121 is arranged in the fixation position, when an original slips into the interspace between the pick roller 41 and the pad 162, the spring 163 deforms elastically and accordingly the pad 162 descends separately from the pick roller 41. For this reason, in the case where the guiding member 83 is fixed to the pick frame 82, when an original slips into the interspace between the pick roller 41 and the pad 162, the pad 162 is able to appropriately push the original against the pick roller 41 by the elastic force applied from the spring 163.

When the fixation lever 121 is arranged in the movability position and an original slips into the interspace between the pick roller 41 and the pad 162, the pick roller 41 ascends such that the pick roller 41 separates from the pad 162. When the fixation lever 121 is arranged in the movability position, the guiding member 83 is pressed firmly against the first stopper 123 of the fixation lever 121 and thus is prevented from ascending and stops in the thick original feed position in which the guiding member 83 is pressed firmly against the first stopper 123. After the guiding member 83 is pressed firmly against on the first stopper 123, the spring 163 deforms elastically and accordingly the pad 162 descends such that the pad 162 separates from the pick roller 41. For this reason, even in the case where the fixation lever 121 is arranged in the movability position, when a thick original 169 slips into the interspace between the pick roller 41 and the pad 162, the pad 162 is able to appropriately push the original against the pick roller 41 by the elastic force that is applied from the spring 163.

In the case where the fixation lever 121 is arranged in the movability position, after caused to ascend by the elastic force applied from the spring 163, the guiding member 83 can be caused to ascend by a small force. For this reason, in the medium conveyance device of the fifth embodiment, the thick original 169 slips into the interspace between the pick roller 41 and the pad 162 and accordingly the guiding member 83 is caused to ascend easily and the thick original 169 easily slips into the interspace between the pick roller 41 and the pad 162. In other words, in the medium conveyance device of the fifth embodiment, the thick original 169 easily slips into the interspace between the pick roller 41 and the pad 87 when the fixation lever 121 is arranged in the movability position and thus it is possible to appropriately feed the thick original 169 via the pick roller 41.

Effect of Medium Conveyance Device of Fifth Embodiment

The medium conveyance device of the fifth embodiment includes the pad 162, the spring 163, and the stopper unit 164. The pad 162 is opposed to the pick roller 41. When an original is interposed between the pad 162 and the pick roller 41, the spring 163 applies an elastic force to the pad 162 such that the original is pushed against the pick roller 41. When the pad 162 is arranged in the given position, the stopper unit 164 limits move of the pad 162 such that the pad 162 does not move to the side of the pick roller 41. The guiding member 83 is supported on the pick frame 82 movably such that, when the pad 162 is arranged in the given position, the pick roller 41 separates from the pad 162. In the medium conveyance device, the pad 162 does not move to the side of the pick roller 41 over the given position and thus a gap is easily formed between the pick roller 41 and the pad 162 and the thick original 169 easily slips into the interspace between the pick roller 41 and the pad 162. In the medium conveyance device, the thick original 169 easily slips into the interspace between the pick roller 41 and the pad 162 and thus it is possible to appropriately feed the thick original 169.

In the medium conveyance devices of the above-described embodiments, the switch unit (for example, the fixation screw 88, the fixation lever 121, or the switch screw 132) that fixes the guiding member 83 to the pick frame 82 is provided. Alternatively, the switch unit may be omitted.

Sixth Embodiment

Figure 25:
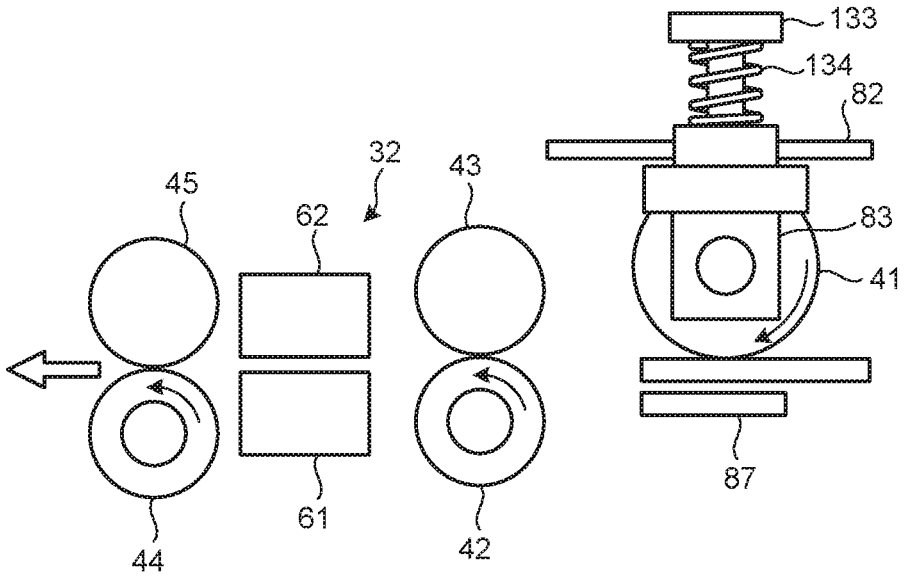
FIG. 25 is a side cross-sectional view of a conveyance device and a read device of a medium conveyance device of a sixth embodiment.

FIG. 25 is a side cross-sectional view of a conveyance device and a read device of a medium conveyance device of a sixth embodiment. As illustrated in FIG. 25, the medium conveyance device of the sixth embodiment is obtained by omitting the switch screw 132 from the medium conveyance device of the above-described third embodiment. When the pick roller 41 does not feed any original or the pick roller 41 feeds a thin original, the guiding member 83 is arranged in the thin original feed position. When the pick roller 41 feeds a thick original, the pick roller 41 ascends to a position corresponding to the thickness of the thick original and accordingly the guiding member 83 is arranged in the thick original feed position.

After placing an original or a plurality of originals on the tray 3 of the medium conveyance device of the sixth embodiment, the user starts the medium conveyance device 1. After started, the medium conveyance device of the sixth embodiment operates as the medium conveyance device 1 of the above-described first embodiment does. In the medium conveyance device of the sixth embodiment, the guiding member 83 is formed movably and thus, as in the medium conveyance device of the first embodiment, the pick roller 41 is arranged in a position corresponding to the thickness of the original and thus it is possible to appropriately feed originals from the tray 3 to the conveyance path 65. In the medium conveyance device of the sixth embodiment, it is unnecessary to fix the guiding member 83 to the pick frame 82 or unfix the guiding member 83 from the pick frame 82 according to originals that are placed on the tray 3 and thus, compared to the medium conveyance device of the above-described other embodiment, the medium conveyance device of the sixth embodiment is easily usable.

In the medium conveyance device of the sixth embodiment, the spring 134 is provided. Alternatively, the spring 134 may be omitted if an original can be sufficiently pushed against the pick roller 41 by their own weight of the guiding member 83 and the pick roller 41.

The conveyance path 65, the conveyance path 66, and the straight conveyance path 68 of the medium conveyance device of the above-described embodiments are formed along a plane that is parallel with the setting surface 8. Alternatively, they may be formed along a plane oblique to the setting surface 8. An oblique plane that has a front side being lower than the back side and that forms an angle of approximately 15 degrees with respect to the setting surface 8 is exemplified as the plane. Even when the medium conveyance device is formed as described above, the pick roller 41 is formed movably and thus it is possible to appropriately feed both thin originals and thick originals from the tray 3 to the conveyance path 65.

The medium conveyance device of the above-described embodiments is used for an image read device. Alternatively, the medium conveyance device may be used for another device. A printer is exemplified as another device. For example, when the medium conveyance device is used for a printer, the read device 32 is replaced with a printing device. Even when the medium conveyance device is used as a device different from the image read device, the pick roller 41 is formed movably and thus it is possible to appropriately feed both thick originals and thin originals from the tray 3 to the conveyance path 65.

The disclosed medium conveyance device makes it possible to appropriately feed thin media and thick media from a stacker.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A medium conveyance device comprising:

a guiding member that is movably supported on a frame;

a pick roller that is rotatably supported on the guiding member and that rotates to feed a medium that is placed on a tray to a feed roller;

a joint unit that transmits a rotation force from a drive shaft to the pick roller;

a separation member that is opposed to the pick roller;

an elastic member that applies an elastic force to the guiding member such that the medium is pushed against the pick roller when the medium is interposed between the separation member and the pick roller; and a stopper that regulates elastic deformation of the elastic member such that the elastic force is not applied to the guiding member when a distance between the pick roller and the separation member is shorter than a predetermined distance.

2. The medium conveyance device according to claim 1, further comprising a switch unit that increases or reduces an area in which the guiding member moves.

3. The medium conveyance device according to claim 2, wherein the switch unit is movably supported such that the switch unit is arranged in any one of a first position and a second position, the guiding member is fixed to the frame when the switch unit is arranged in the first position, and the guiding member is supported on the frame such that the guiding member is movable when the switch unit is arranged in the second position.

4. The medium conveyance device according to claim 1, further comprising:

a separation member that is opposed to the pick roller;

an elastic member that applies an elastic force to the separation member such that the medium is pushed against the pick roller when the medium is interposed between the separation member and the pick roller; and a stopper that limits movement of the separation member such that the separation member does not move to a side of the pick roller when the separation member is arranged in a given position, wherein the guiding member is movably supported such that the pick roller separates from the separation member when the separation member is arranged in the given position.

* * * * *